US006401979B1

(12) United States Patent
Mekata et al.

(10) Patent No.: US 6,401,979 B1
(45) Date of Patent: Jun. 11, 2002

(54) DOUBLE PRESSURIZED CONTAINER FOR CHARGING UNDERCUP AND DOUBLE PRESSURIZED PRODUCTS USING THE CONTAINER

(75) Inventors: Satoshi Mekata, Osaka; Masazumi Tanaka, Kyoto, both of (JP)

(73) Assignee: Osaka Shipbuilding Co., Ltd., Osaka (JP)

( * ) Notice: Subject to any disclaimer, the term of this patent is extended or adjusted under 35 U.S.C. 154(b) by 0 days.

(21) Appl. No.: 09/509,896

(22) PCT Filed: Oct. 1, 1998

(86) PCT No.: PCT/JP98/04446

§ 371 (c)(1),
(2), (4) Date: Apr. 3, 2000

(87) PCT Pub. No.: WO99/16684

PCT Pub. Date: Apr. 8, 1999

(30) Foreign Application Priority Data

Oct. 1, 1997 (JP) ..... 9-285987

(51) Int. Cl.[7] ..... B65D 35/56

(52) U.S. Cl. ..... 222/105; 222/95; 222/402; 222/1

(58) Field of Search ..... 222/95, 105, 386.5, 222/402.1, 183, 131

(56) References Cited

U.S. PATENT DOCUMENTS 3,938,708 A * 2/1976 Burger ..... 222/95
4,117,951 A * 10/1978 Winckler ..... 220/461
4,148,416 A * 4/1979 Gunn-Smith ..... 222/94
4,150,522 A * 4/1979 Burger ..... 53/470
5,007,556 A * 4/1991 Lover ..... 222/386.5
5,069,363 A * 12/1991 Daimler ..... 222/95
5,115,944 A * 5/1992 Nikolich ..... 222/94
5,123,560 A * 6/1992 Arzani et al. ..... 222/95
5,277,336 A * 1/1994 Youel ..... 222/105
5,622,282 A * 4/1997 Yazawa et al. ..... 222/95

FOREIGN PATENT DOCUMENTS

| | | |
|---|---|---|
| JP | 3-111280 | 5/1991 |
| JP | 3-64272 | 6/1991 |
| JP | 3-84786 | 8/1991 |
| JP | 4-53690 | 5/1992 |
| JP | 8-143076 | 6/1996 |
| JP | 9-118380 | 5/1997 |

* cited by examiner

*Primary Examiner*—Kenneth Bomberg
*Assistant Examiner*—Frederick C Nicolas
(74) *Attorney, Agent, or Firm*—Browdy and Neimark

(57) ABSTRACT

A pressurized container (A) for charging an undercup comprising a container main body (1) equipped with a bead portion (6) around an upper end open periphery thereof, a mounting cup (18) having a curve flange (18*d*) engaged with the bead portion (6) and an inner bag (2) having flexibility and interposed between the container main body (1) and the mounting cup (18), wherein the inner bag (2) includes a neck portion (10) in close contact with the outer peripheral surface of a rising wall of the mounting cup with a predetermined fitting strength and a flange portion (11) disposed at the upper edge of the neck portion and clamped between the curve flange and the bead portion, and the flange portion (11) exhibits a sealing action when pushed to the inner surface of the curve flange (18*d*) by a charging pressure at the time of charging of the undercup and a sealing action when it is clamped between the curve flange (18*d*) and the bead portion (6) after assembly.

7 Claims, 20 Drawing Sheets

DOUBLE PRESSURIZED CONTAINER FOR CHARGING UNDERCUP AND DOUBLE PRESSURIZED PRODUCTS USING THE CONTAINER

FIELD OF THE ART

The invention relates to a double pressurized container for under-cup charging and a double pressurized product using the same. More specifically, the present invention relates to improvements for facilitating under-cup charging in a double pressurized product which is equipped with a container main body with an opening at its upper end, an attached mounting cup for closing the opening, and an inner bag which has flexibility and which is interposed between the container main body and the mounting cup.

BACKGROUND ART

There has been known such a double pressurized product as a dispenser or aerosol product, which houses a flexible inner bag in its container main body and also which charges the inner bag with a content, i.e. concentrate to be discharged and also charges such a propellant as a pressurized gas between the inner bag and the container main body. The content housed in such a double pressurized product can be directly charged into the inner bag via an ejecting valve or through an opening in the inner bag. The propellant, on the other hand, is charged by either of two methods of charging it through a charging valve independently disposed at a bottom of the container main body or charged through a gap between a flange portion of a mounting cup and a bead portion of the container main body directly before the ejecting valve is crimped to the opening in the container main body using the mounting cup, which is so-called an under-cup charging method.

A double pressurized product equipped with a charging valve needs additional machining of its container main body and mounting of an independent charging valve, thus increasing its manufacturing cost. Therefore, an under-cup charging method has been proposed so far. This under-cup charging method, however, needs to charge a propellant through a gap between its inner bag and a container main body to be sealed in an air-tight manner finally. With this, in particular, in such a type of a double pressurized container that a flange portion of the inner bag is hung at bead portion disposed in an opening in the container main body, the inner bag needs various devices such as having vertical ribs for securing a passage for the passage (see, for example, Japanese Patent Application Laid-Open Nos. Sho-56-84270 and Sho-57-104571).

Also, since a propellant is charged with a high pressure of 0.3–5.0 Mpa, it may enter the inner bag at a gap between the inner bag (its flange portion) and the mounting cup (its curved flange portion) through between the neck portion of the inner bag and the rising wall of the mounting cup. Also, as mentioned above, the propellant (particularly in the case of a nitrogen gas, which has a lower solubility into the concentrate) is charged with a high pressure, part of the propellant which penetrated into the inner bag through the gap may cause a burst of the inner bag, which is a problem. The above-mentioned Japanese Patent Application Laid-Open Nos. Sho-56-84270 and Sho-57-104571 suggest that an adhesive agent or a sealant should be interposed between the inner bag and the mounting cup in order to prevent such penetration.

Japanese Patent Application Laid-Open No. Hei-9-2551, on the other hand, suggests such a method for manufacturing a double pressurized product that a propellant should be charged between the container main body and the inner bag beforehand and then part of the propellant leaked into the inner bag should be discharged by, for example, vacuum suction and then a content should be charged into the inner bag. With this method, no propellant may enter the inner bag. With this method, moreover, the inner bag, when empty, is engaged with and held at a bead portion of the main body, so that the engagement need not to be heavy, thus making it possible to disengage it easily. Also, Japanese Utility model Publication No. Hei-3-4373, though not relating to under-cup charging, discloses a method of folding back the flange portion of the inner bag 2-ply, to omit a gasket.

The above-mentioned method of interposing an adhesive agent or a sealant between the inner bag and the mounting cup is difficult to put into practice in the present-day assembly-line mass-production step portions whereby the inner bag and the mounting cup are manufactured independently of each other and then mounted at a charging step portion. In addition, the method by the above-mentioned Japanese Patent Application Laid-Open No. Hei-9-2551 of under-cup-charging a propellant beforehand and removing part of the propellant entered into the inner bag and then charging the inner bag with a content needs to charge the content against an inner pressure, thus being undesirable because of its double-step portion operations.

The present invention attempts technologically to minimize as much as possible the penetration of a propellant. into an inner bag without changing the conventional under-cup charging method as much as possible.

It has been found that such penetration of a propellant through a gap can be reduced to some extent by enhancing the strength of sealing between the inner bag and the mounting cup. The inner bag, however, has a flexibility and the flange portion of the inner bag cannot be prevented from being lifted, so that it is impossible to prevent penetration sufficiently. With this, the Inventor has analyzed and discussed about a mechanism of penetration into the inner bag at the time of under-cup charging with a conventional double pressurized product. As a result, the Inventor has found that in the case of a double pressurized container using a container main body having a bead portion, a gasket placed inside the curved flange portion of the mounting cup has a significant function on the penetration of a propellant into the inner bag.

That is, in such a double pressurized product, as shown in FIG. 19*a*, in a curved flange portion 102 of a mounting cup 101 is housed a rubber-made ring-shaped gasket 104 for sealing a gap between the curved flange portion and a bead portion 103 of a container main body. Then, as shown in FIG. 19*b*, after assembly, the gasket 104 is abutted against the bead portion 103 directly in order to provide a secure sealing function, so that an outer diameter of a flange portion 106 of an inner bag 105 is made a little smaller than that of the gasket 104.

Therefore, when, during assembly, a valve assembly is once mounted on the upper part of the container main body and then lifted up for under-cup charging, as shown in FIG. 20, the gasket 104 is in close contact with the curved flange portion therein and, on the other hand, an outer periphery of the flange portion 106 of the inner bag is separate from the surface of the gasket 104 or only a slightly abutted against it. Therefore, it is considered that at the time of under-cup-charging, the outer periphery of the flange portion 106 is lifted up, thus permitting a propellant to enter the inner bag through a gap 107.

With this, the Inventor has devised the present invention, considering that the above-mentioned problem of penetration of a propellant at the time of under-cup charging can be prevented significantly by enhancing a degree of contact between the inner bag and the mounting cup and also by employing a sealing structure between the mounting-cup and the container main body basically providing no gasket or, even if a gasket is provided, by employing such a sealing structure as not to give rise to the above-mentioned problem.

Disclosure of Invention

From the viewpoint of the above, a double pressurized container for under-cup charging according to the present invention comprises a container main body equipped with an opening at its upper end, a mounting cup attached for closing the opening, and an inner bag which has flexibility and also which is interposed between the container main body and the mounting cup, wherein the above-mentioned inner bag is equipped with a neck portion which is in close contact with an outer periphery of a rising wall of the mounting cup and also which abuts against that periphery with predetermined fitting strength.

Further, in this double pressurrized container, no gasket is provided in the curved flange of the mounting cup, the above-mentioned container main body is equipped at its opening with a bead portion, which is covered by a curved flange equipped to the mounting cup, and the inner bag, on the other hand, is equipped at its upper end with a flange portion which is engaged with the bead portion, which flange portion is given such defined shape, elasticity, or flexibility that it exhibits a sealing function when it is pushed against an inner surface of the curved flange with a charging pressure at the time of the under-cup charging. In another aspect of the above-mentioned double pressurized container for the inner bag, it has, for example, a lip shape such that it exhibits a sealing function when pushed against the inner surface of the curved flange with a charging pressure at the time of the under-cup charging.

In still another aspect of the double pressurized container, the above-mentioned inner bag flange portion has defined thickness and elasticity such that it exhibits a sealing function onto the container main body and the inner bag when it is clamped between the curved flange and the bead portion. Still another aspect of the double pressurized container, the flange, the container main body bead portion, and/or the mounting-cup curved flange are integrated into a line-sealing structure. Such a line-sealing structure can be realized by forming a continuous-annular irregular strip which meshes the inner-bag flange portion at a site where an outer surface of the container main-body bead portion and an inner surface of the mounting-cup curved flange, in which case when the flange portion is clamped between the bead portion and the curved flange, a line sealing structure is formed between the irregular strip and the flange portion. Also, the flange portion of the inner bag may have an annular step portion or thick portion, in which case that step portion or thick portion constitutes a line sealing structure when the flange portion is clamped between the bead portion and the curved flange.

The second aspect of the double pressurized container for under-cup charging comprises container main body equipped with an opening at its upper end, a mounting cup attached for closing the opening, and an inner bag which has flexibility and also which is interposed between the container and the mounting cup, the mounting cup having a plug inserted into an inner surface of the container main body with the inner bag therebetween and a cup-shaped cover made of metal sheet which covers the plug and which is crimped at its periphery against the outer periphery of the container body, wherein the inner bag has a cylindrical portion which abuts against the outer surface of the plug of the mounting cup closely with predetermined fitting strength, wherein the fitting size of the plug and that of the inner bag are such that the inner bag may be fit as being expanded slightly. In this preferred aspect of the double pressurized container, the container main body comprises a cylindrical portion at its upper part and an annular protrusion which protrudes inward at the lower part of the cylindrical portion, wherein the inner bag has another cylindrical portion which is fit to the cylindrical portion of the container main body and also the inner. bag is sealed when clamped between the side-wall step portion of the mounting cup and the annular protrusion. In still another aspect of the double pressurized container equipped with the above-mentioned plug and the mounting cup, it has a flange portion which covers the entire container main body and the upper end of the inner bag. In still another aspect, a gasket is interposed between the plug and the inner bag in order to seal them tightly.

In any of the above-mentioned double pressurized container, the inner bag may have a height enough to be supported at its bottom by an inner bottom of the container at the time of under-cup charging.

A double pressurized product according to the present invention comprises any of the above-mentioned pressurized containers, a concentrate charged in the inner bag of the pressurized container, and a propellant charged in a gap between the inner bag and the container main body.

A tandem-type double pressurized product according to the present invention features coupling the above-mentioned double pressurized products two at a time.

In the above-mentioned double pressurized container according to the present invention, the neck portion of the inner bag is in close contact with the outer peripheral surface of the rising wall of the mounting cup and also abuts against that surface, so that air-tightness is improved so as to prevent a propellant from entering the inner bag through the gap at the time of under-cup charging.

In still another aspect of the double pressurized container, size, elasticity and flexibility of the flange portion of the inner bag are predefined so that a sealing function may be exhibited when the flange portion is pushed against the inner surface of the curved flange with a charging pressure. Therefore, a tip of the flange is not easily lifted up, thus suppressing a propellant from entering through the lifted portion. A small amount of the propellant, even if entered, does not give rise to such a pressure as to expand a sealed portion because the neck portion of the inner bag strongly abuts against the outer peripheral surface of the rising wall of the mounting cup. With this, the propellant can be prevented from entering the inner bag.

In still another aspect of the double pressurized container, the outer periphery of the flange portion of the inner bag has a lip shape so that a sealing function may be exhibited when the outer periphery of the flange portion of the inner bag is pushed against the inner surface of the curved flange with a charging pressure at the time of under-cup charging. Therefore, at the time of under-cup charging, the outer periphery of the flange comes in close contact with the inner surface of the curved flange in order to be pushed against the inner surface of the curved flange more strongly with the increasing charging pressure, thus further suppressing leakage into the inner bag.

In still another aspect of the double pressurized container, the inner bag flange portion has predefined thickness and elasticity such that a sealing function may be exhibited between the container main body and the inner bag when the flange portion is, after assembly, clamped between the curved flange and the bead portion. With this, the inner bag operates in place of a conventional gasket, thus eliminating the necessity of the gasket. This bring about even easier close contact between the inner bag flange portion and the mounting cup curved flange inner surface, thus further improving a sealing function at the time of the under-cup charging.

With this, a smaller number of parts are required, thus facilitating assembly.

In still another aspect of the double pressurized container, the flange portion, the container main body bead portion, and/or the mounting cup curved flange are integrated into a line sealing structure. With this, after assembly, the force clamping the flange portion upward and downward is concentrated at one position on the line sealing portion, thus improving the sealing function as a pressurized product.

In still another aspect of the double pressurized container, such a line sealing structure is given by forming a continuous annular irregular strip which meshes with the flange portion of the inner bag, at such a site where the outer surface of the container main body bead portion and the inner surface of the mounting cup curved flange correspond to each other. With this, after assembly, the inner bag flange portion meshes with the bead portion at the irregular strip, thus obtaining a line sealing structure with a higher sealing function at that annular irregular strip. This effectively suppresses gas leakage after assembly.

In the second aspect of the double pressurized container, the mounting cup comprises a plug inserted into the inner surface of the container main body with the inner bag therebetween and a cup-shaped cover made of a metal sheet which covers the plug and also which has its periphery crimped to the outer periphery of the container main body, in such a configuration that the plug may be fitted, in size, to the inner bag while expanding the inner bag slightly. With this, there is given even stronger fitting between the mounting cup plug and the inner bag, thus further preventing a propellant from entering the inner bag at the gap at the time of under-cup charging. In this preferred aspect of the double pressurized container, the container main body comprises a cylindrical portion at its top and an annular protrusion at the bottom of the cylindrical portion which protrude inward, in such a configuration that the inner bag has a cylindrical portion fitted to the cylindrical portion of the container main body and also the inner bag is sealed when it is clamped between the mounting cup side step portion and the annular protrusion. Therefore, the inner bag may be sealed sufficiently.

In still another preferred aspect, the above-mentioned plug is equipped with a flange portion which covers the container main body and the upper end of the inner bag. With this, the inner bag and the container main body upper end are sufficiently protected by the flange portion. In still another preferred aspect, a gasket is interposed between the above-mentioned plug and the container main body upper end. With this, the inside of the container main body is sufficiently sealed from the outside. In still another preferred aspect, a gasket is interposed between the plug and the inner bag for sealing. With this, the above-mentioned gasket acts to provide a tight sealing function between the plug and the inner bag, thus sufficiently sealing the inside of the inner bag.

In still another preferred aspect of the double pressurized container according to the present invention, the inner bottom of the container main body supports the inner bag charged with a content at the time of under-cup charging. With this, it is not necessary to hold the inner bag when a propellant is charged and, also, the fitting between the inner bag neck portion and the plug is not shifted by a weight of the content.

The double pressurized product according to the present invention has the above-mentioned pressurized container charged with a concentrate and a propellant, so that little amount of the propellant enters the inner bag.

A tandem-type double pressurized product according to the present invention employs the above-mentioned type of the double pressurized product, so that each of the product may exhibit all the above-mentioned functions and effects. Also, it is possible to reserve two kinds of agents separately to eject them at the same time and mix them directly before use.

Figure 1:
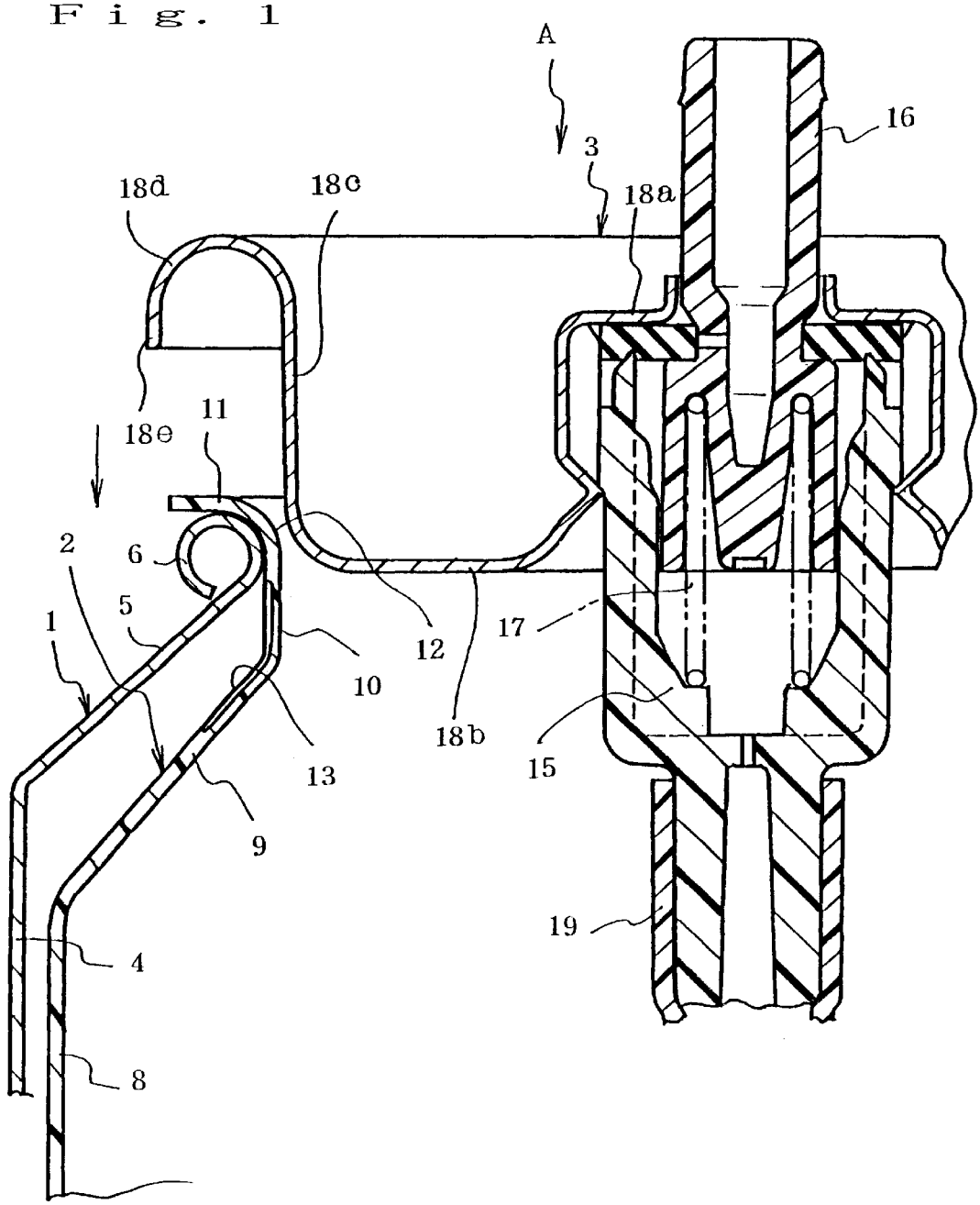
FIG. 1 is a cross-sectional view showing an important part of a pre-assembly double pressurized container according to one embodiment of the present invention.

BEST MODE FOR CARRYING OUT THE INVENTION:

A double pressurized container A shown in FIG. 1 comprises a container main body 1, an inner bag 2 housed in the container main body 1, and a valve assembly 3 for closing an upper opening in the container main body. The container main body 1, having a conventionally known form, is made by forming a metal sheet into a bottomed-cylinder equipped with a barrel portion 4 and a bottom (not shown) and continuously attaching a conical shoulder portion 5 to the upper end of the barrel portion and then providing a bead portion 6 at the cylinder portion upward extending from that upper end by performing outward curling. As the metal sheet, aluminum or tinned steel sheet is used. Although the container main body 1 is shown as formed of one sheet of metal sheet in FIG. 1, as described later, the barrel portion 4 may be wind-formed and, at its upper end, separately formed shoulder portion or dome may be fixed by double-wind-tightening (see FIGS. 10–11).

The above-mentioned inner bag 2 comprises a cylindrical barrel portion 8, a conical shoulder portion 9 continuously extending from an upper end thereof, a cylindrical neck portion 10 upward extending from an upper end thereof, and a flange portion 11 outward expanding an upper end thereof. In this embodiment, the flange portion 11 extends approximately to an outer periphery of the bead portion 6 in a plane roughly perpendicular to an axis of the neck portion 10. From an upper part of the neck portion 10 to the flange portion 11, a curved portion 12 is disposed in contact with the bead portion 6 of the container main body 1. Also, from a lower half of the neck portion 10 to the shoulder portion 9, a recess groove 13 is disposed which provides a passage for a propellant at the time of under-cup charging. Preferably, the recess groove 13 is arranged two or more for example in a radial manner.

The inner bag 2 is formed by performing, for example, blow-molding on synthetic resin with gas-barrier nature. The possible materials of the inner bag may include a single-layer or stack-layer sheet made of straight-chain low-density polyethylene (LLDPE), low-density polyethylene (LDTE), high-density polyethylene (HDPE), polypropylene (PP), polyethylene telephtalate (PET), polybutylene telephtalate (PBT), polyethylene naphthalate (PEN), polyacrylonitrile (PAN), ethylene vinyl alcohol copolymer (EVOH), and nylon (NY). For example, a three-layer stack film may be used which is made of three layers of LDPE/EVOH/LDPE. The thickness of the inner bag 2 is 0.1–2.0 mm, preferably 0.3–0.8 mm approximately. The inner bag 2 may be made by blow-molding from the above-mentioned single-layer or stack-layer sheet or folding the sheet in a bag and then bonding its circumference. In the latter case, it may also be made from a stack-layer sheet including a metal foil sheet such as an aluminum foil.

The valve assembly 3 is a known element which comprises a bottomed-cylindrical housing 15, a stem 16 housed movable up and down in the housing, a spring 17 for urging the stem always upward, a mounting cup 18 covering the upper end of the housing 15 and extending to a circumference. At the lower end of the housing 15, an upper end of a dip tube 19 is fitted. The dip tube 19 need not always be provided. The mounting cup 18 is a known element made of a metal sheet which comprises a housing holding portion 18*a* for enclosing and holding the upper part of the housing 15, a bottom plate 18*b* extending outward from around the lower end thereof, a cylindrical rising wall 18*c* rising from a periphery of the bottom plate, and a curved flange 18*d* capped onto the bead portion 6 of the container main body 1. This embodiment, however, does not employ the conventionally used gasket in the curved flange.

That is, a conventional pressurized container, no matter whether it is of a usual type or a double pressurized type, employs an annular gasket made of elastomeric material such as soft synthetic resin, natural rubber, synthetic rubber such as acrylonitrile butadiene rubber (NBR), stylene butadiene rubber (SBR), butadiene rubber (BR), butyle rubber (IIR), isoprene rubber (IR), chloroprene rubber (CR), ethylene propylene rubber (EPT, EPDM), fluorine rubber, silicone rubber, to seal a gap between the mounting cup curved flange and the bead portion. In the double pressurized container, the inner bag flange portion sandwiched between these two portions extends only to the upper end of the bead portion in order not to prevent abutting between the gasket and the bead portion.

In this embodiment, however, the gasket is omitted, and the inner bag 2 flange portion 11 is provided to seal the gap between the mounting cup 18 and the bead portion 6, and also the flange 11 is provided to extend at its outer periphery close to an outer periphery of the bead portion 6.

Thus configured container main body 1, the inner bag 2, and the valve assembly 3 are assembled as follows. First, as shown in FIG. 1, the inner bag 2 is inserted into the container main body 1. Since the inner bag 2 has flexibility, it can be inserted into the container main body 1 through a small opening in its upper end. In this state, i.e. with the valve assembly 3 not being disposed at the upper part of the container main body 1, a concentrate to be ejected is charged into the inner bag 2.

Figure 2:
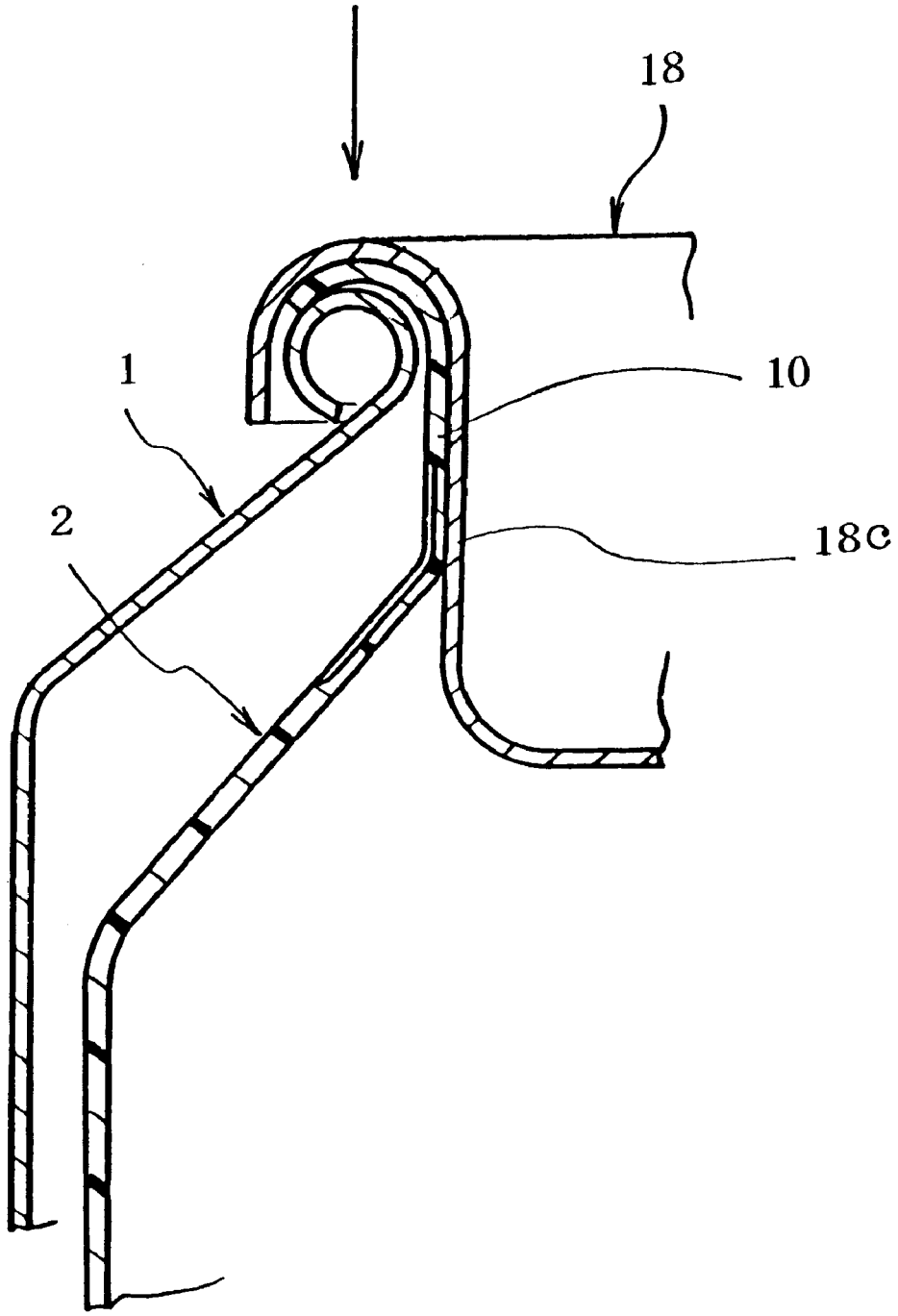
FIG. 2 is a cross-sectional view showing the important part in process of assembly.

Next, as shown in FIG. 1 again, the valve assembly 3 is disposed at the upper part of the container main body 1 and then lowered so that, as shown in FIG. 2, the rising wall 18*c* of the mounting cup 18 may be inserted into the neck portion 10 of the inner bag 2. The outer diameter of the rising wall 18*c* and the inner diameter of the neck portion 10 are predetermined so as to provide rather tight fitting between them. The neck portion 10 of the inner bag 2. is therefore securely fit to the rising wall. 18*c* of the mounting cup 18 with a predetermined fitting strength (loosening strength).

Figure 3:
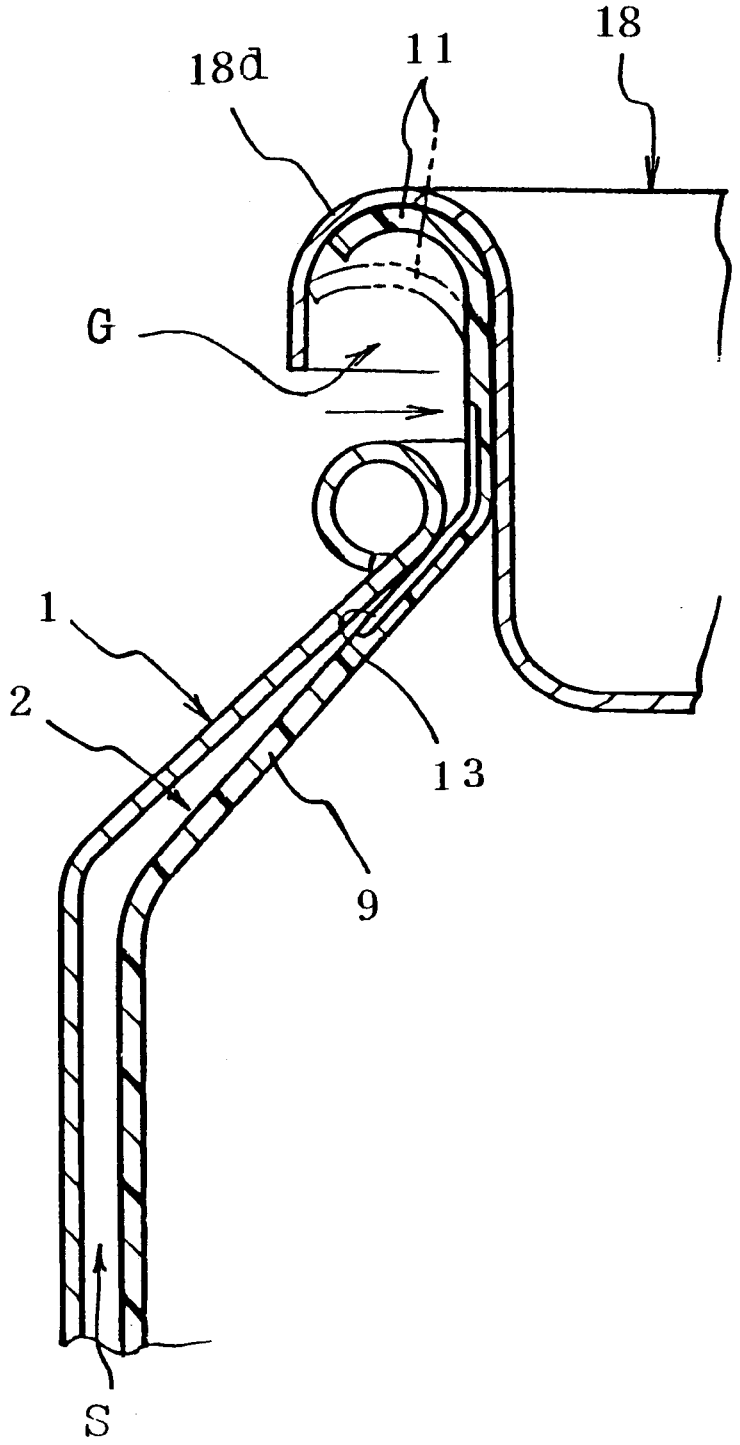
FIG. 3 is a cross-sectional view showing the important part at the time of under-cup charging.

In this state, when the valve assembly 3 is lifted up with a gas charging pressure or by use of an auxiliary-use vacuum device, as shown in FIG. 3, the inner bag 2 charged with the concentrate is also lifted up together with the valve assembly, since the fitting strength is high. With this, there is given a gap G between the bead portion 6 and the lower end of the outer wall 18*e* of the curved flange 18*d*. In this case, however, the bottom of the inner bag 2 is supported by the inner bottom of the container main body, the inner bag need not be lifted up. The inner bag 2 flange portion 11 may extend in a plane as indicated by an imaginary line in FIG. 3 or may curve along an inner surface of the curved flange 18*d* as indicated by a solid line. When extending in a plane, the flange portion 11, at its outer side, comes in close contact with the inner surface of the outer wall 18*e* of the curved flange 18*d*. Though the area from the inner peripheral surface of the bead portion 6 of the container main body 1 through its lower surface abuts against the neck portion 10 and the outer surface of the shoulder portion 11 of the inner bag 2, the gap G becomes in mutual communication with the inside of the container main body 1 through a recess groove 13. With this, a conventionally known charging device is used to charge with a high pressure a propellant via the gap G and the recess groove 13 into a space S between the container main body 1 and the inner bag 2. Specifically, the charging device (not shown) charges the propellant through respective gaps between two ring-shaped members each provided with a seal ring with fitting those two members in a sealing state against the outer surface of the barrel portion 4 of the container main body 1 and the outer surface of the outer wall 18*e* of the curved flange 18*d* of the mounting cup 18 respectively to which these two members are fit in a sealing state.

In this case, the flange portion of the inner bag 2 is strongly pressed with the propellant's pressure to the inner surface of the curved flange 18*d*, thus exhibiting a sealing function. That is, it exhibits the same function as a "lip" of a lip-type seal ring does, thus preventing the propellant from entering the inner bag 2 through the gap between the inner bag 2 and the curved flange 18*d*. In such a way, the propellant is charged under a high pressure through the recess groove 13 into the space S between the container main body 1 and the inner bag 2.

Figure 4A:
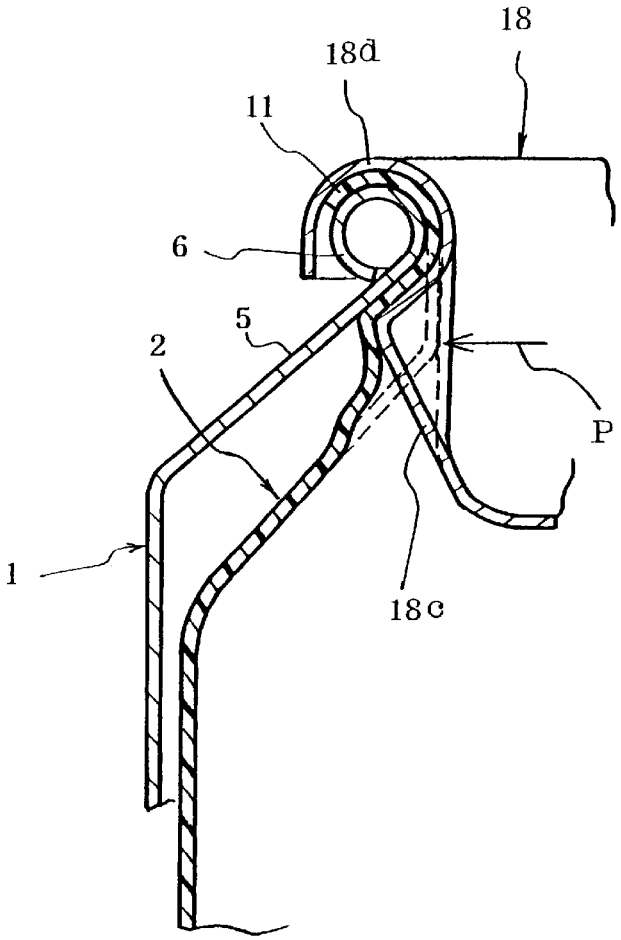
FIGS. 4*a* and 4*b* are cross-sectional views respectively showing the important part and the entire product after assembly.
Figure 4B:
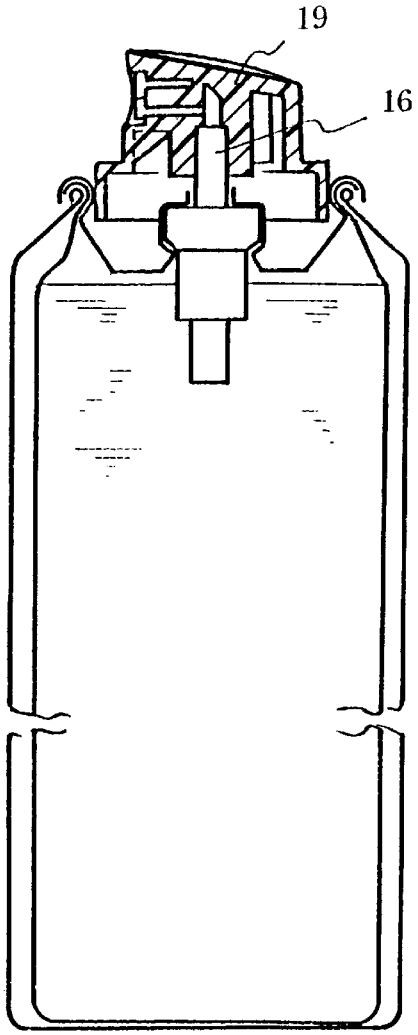
Figure 12:
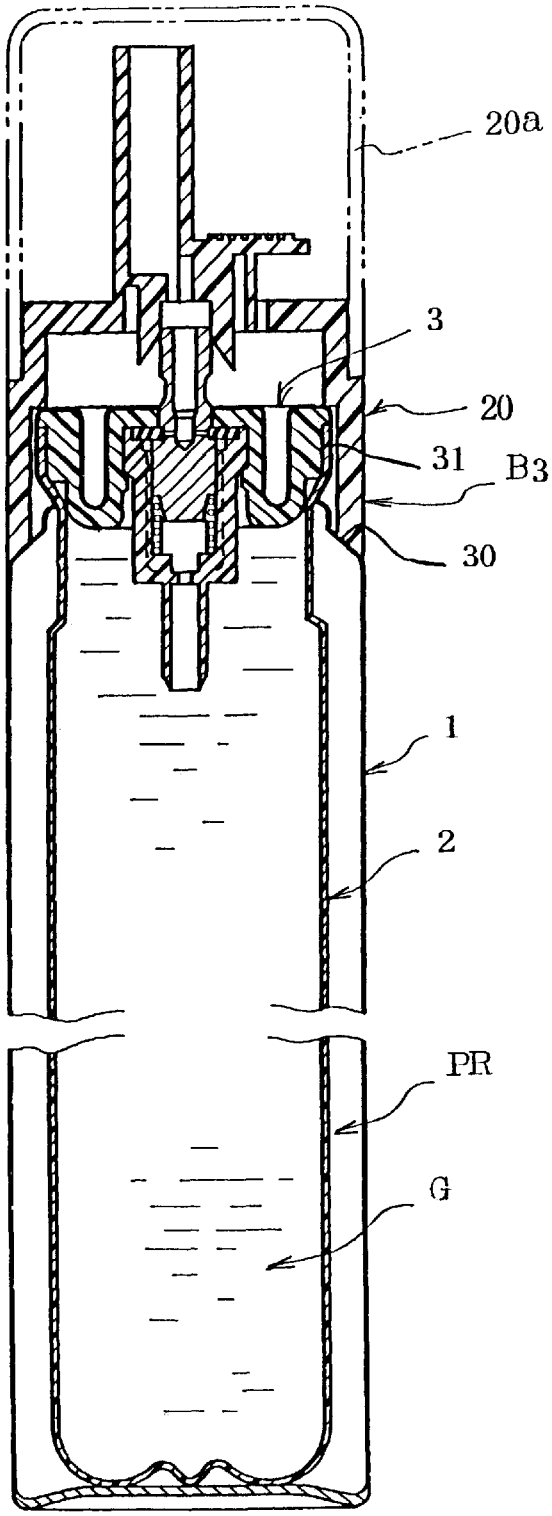
FIG. 12 is a vertical cross-sectional view showing the double pressurized product according to a still another embodiment of the present invention and FIG. 13 is an expanded cross-sectional view showing the important part thereof.

Afterward, like in the case of conventional methods, the valve assembly 3 is lowered to securely sandwich, as shown in FIG. 4*a*, the inner bag 2 flange portion 11 between the curved flange 18*d* and the bead portion 6, thus exhibiting a sealing function. Then, using claws of a crimping device to push the rising wall 18*c* of the mounting cup 18 outward partially (see an arrow P), to cause that portion to abut against. the inner surface of the shoulder portion 5 of the container main body 1, thus crimping the valve assembly 3 to the container main body 1. Then, as shown in FIG. 4*b*, a push button 19 is mounted to the stem 16 or, as shown in FIG. 12, a one-touch cap 20 and a cover cap 20*a* are mounted, to complete assembling of the double pressurized products B and B3.

As mentioned above, in this double pressurized container A, the gasket in the curved flange 18*d* is omitted, to permit the flange portion 11 in the inner bag 2 to seal the gap between the mounting cup 18 and the container main body 1, so that the outer periphery of the flange portion 11 can be extended to the outer periphery of the bead portion 6, thus coming in close contact with the inner surface of the curved flange 18*d* at the time of under-cup charging. With this, the propellant does not enter the inner bag 2 through the gap between the. flange portion 11 and the curved flange 18*d*. Therefore, reaction can be avoided between the concentrate and the propellant, and the inner bag can be prevented from bursting. Also, there is no additional need to release the propellant after under-cup charging and then charge a new propellant.

Figure 5A:
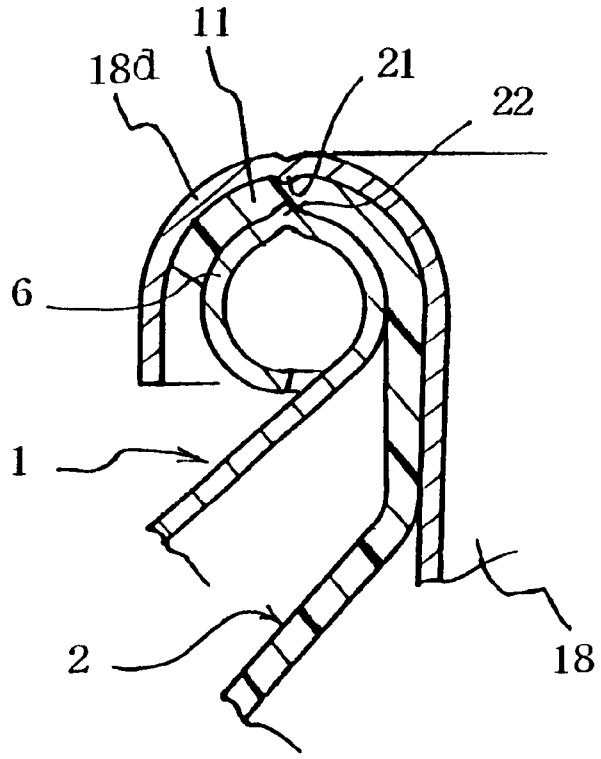
FIGS. 5*a* and 5*b* are cross-sectional views showing other respective embodiments of the double pressurized container according to the present invention.
Figure 5B:
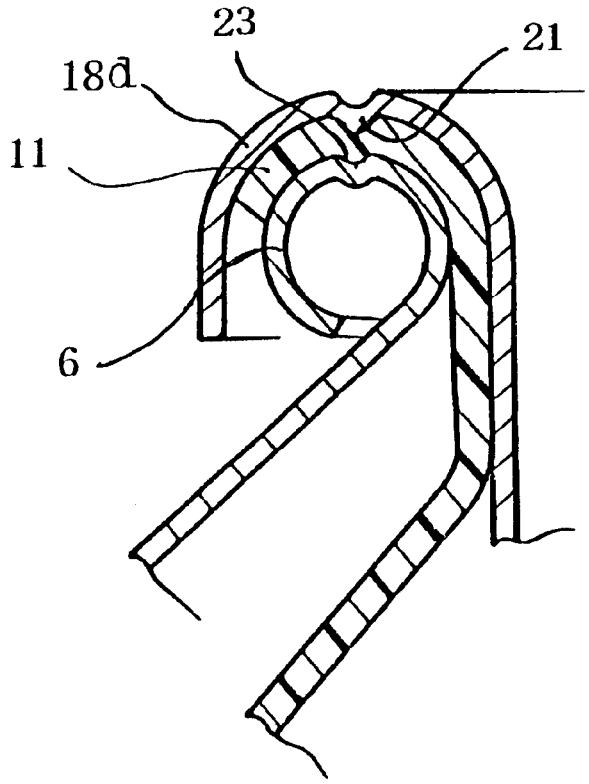

As in the case of the above-mentioned double pressurized container A, only by clamping the inner bag 2 flange 11 between the mounting cup 18 curved flange 18*d* and the container main body 1 bead portion 6, a sufficient sealing function can be obtained. In this case, specifically, the flange portion 11 is clamped with an annular portion with a predetermined width between the upper part inner surface of the curved flange 18*d* and the top of the bead portion, so that care must be taken sufficiently in, for example, centering between the bead portion 6 and the curved flange 18*d*. Also, if the inner bag is made of soft synthetic resin, there is provided a lower elastic deformation degree than with a rubber-made gasket, so that sealing leakage may occur at such a site as having a lower clamping pressure. Therefore, the flange portion 11 should preferably be thicker than the other sites, e.g., 0.2–3.0 mm and preferably 0.3–2.0 mm. As shown in FIGS. 5*a* and 5*b*, on the other hand, an annular irregular portion, i.e. protruding or recessing portion, should preferably be formed on at least one of the curved flange 18*d* and the bead portion 6, to mesh with the flange portion 11, thus constituting a so-called line-sealing state. In this case, the pressing pressure is high locally, thus further improving the sealing function.

On the double pressurized container shown in FIG. 5*a*, a continuous annular protrusion strip 21 protruding toward the inner surface (lower side) is formed near the top of the curved flange 18*d*. Near the top of the bead portion 6 also, a continuous annular protrusion strip 22 protruding outward is formed. These annular protrusion strips 21 and 22 can both be formed by performing for example coining machining on a blank material before being curl-formed. By using these annular protrusion strips 21 and 22 to cause the flange portion to mesh at both its top and back surfaces, a line-sealing structure can be obtained, thus improving the sealing function. With this, even if relaxation occurs, the sealing function is not lost.

In the double pressurized container shown in FIG. 5*b*, almost the same annular protrusion strip 21 as the above-mentioned one is formed near the top of the curved flange 18*d*, and near the top of the bead portion 6, a continuous annular recess groove (V groove) 23 is formed. This annular recess groove 23 can also be formed by performing for example coining machining on a blank material before curl-forming. Then, the annular protrusion strip 21 is combined with the annular recess groove 23 as being fit therein, thus clamping therebetween the flange portion 11 of the inner bag 2. This also meshes with the flange portion 11 securely, thus providing a line sealing structure. Also, the annular protrusion strip may be formed on the side of the bead portion 6, and a continuous annular recess groove may be formed on the curved flange 18*d* side.

Figure 6:
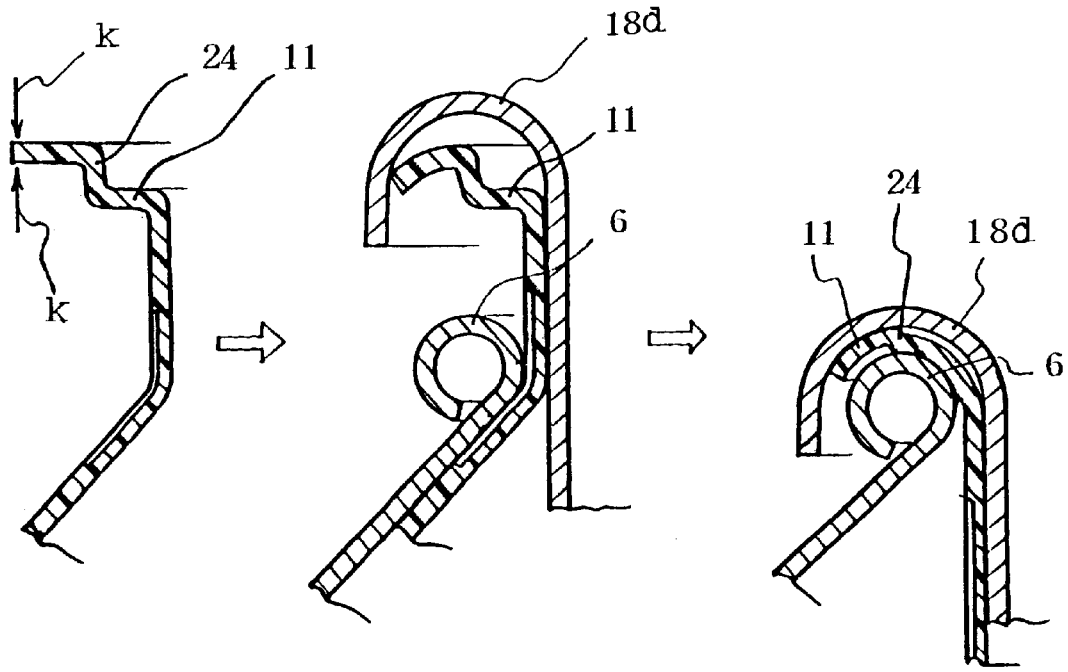
FIG. 6 is a cross-sectional step view showing a procedure for assembling a double pressurized container according to still another embodiment of the present invention.

FIG. 6 shows another embodiment for obtaining a line-sealing structure. In this embodiment, the inner bag 2 is provided at its flange portion 11 with an annular step portion 24, and the flange portion 11 is clamped between the bead portion 6 and the flange 18*d*. With this, there is provided such a state that, as shown in the rightward step in FIG. 6, only the site of the annular step 24 is made thick, to support the pushing pressure of the two parties. This leads to a higher sealing pressure, to improve the sealing function.

To form the annular step portion on the inner bag 2 to be blow-molded, as shown in the leftmost step of FIG. 6, it can be blow-molded into a shape of the step flange 11 and then its ends which provide a periphery of the flange portion 11 can be cut as shown by arrows K and K.

Figure 7A:
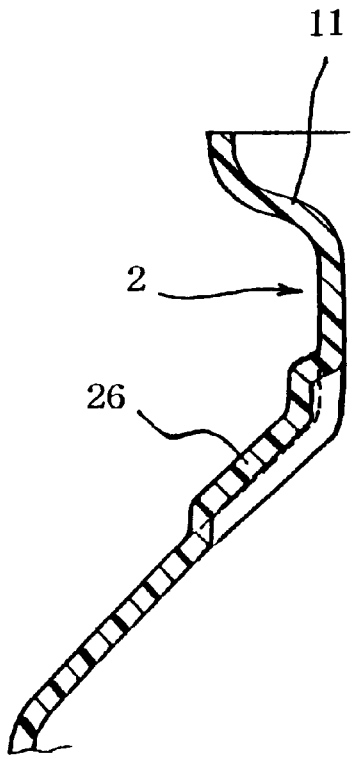
FIGS. 7*a* and 7*b* are cross-sectional views showing the important part of the double pressurized container according to a still another embodiment of the present invention.
Figure 7B:
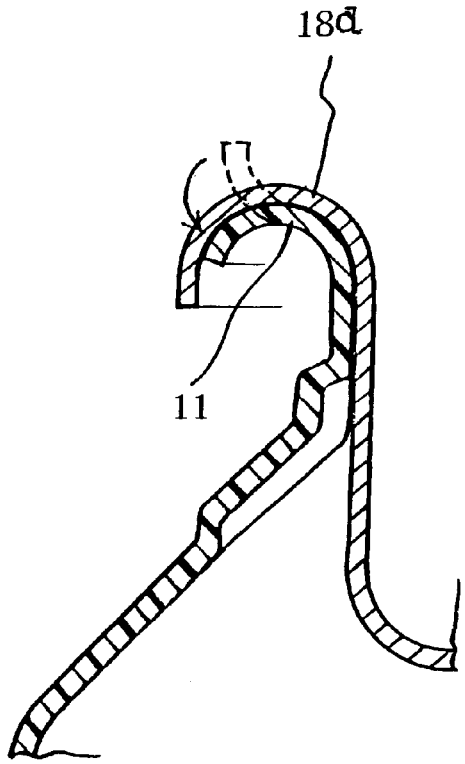

The inner bag 2 shown in FIG. 7*a* is formed into such a shape that the flange portion 11 has a moderate S-shaped cross section and the outer peripheral part is curved upward and cut at its upper end. When this flange portion 11 is inserted into the curved flange 18*d* as shown in FIG. 7*b*, the upward curving outer peripheral portion turns downward, coming in close contact with the inner surface of the curved flange 18*d*. Moreover, it still has upward elastic force always. With this, there is provided strong sealing force between the flange portion 11 and the curved flange 18*d*, thus preventing a propellant from entering the inner bag through the gap therebetween at the time of under-cup charging.

The inner bag 2 shown in FIGS. 7*a* and 7*b*, does not employ the thinning recess groove 13 shown in FIG. 1 but instead has an protrusion strip 26 having an upward curving and protruding cross section formed from the neck portion 10 to the shoulder portion 9. This protrusion strip 26 is preferably provided two or more in a radial manner. Such protrusion strips 26 abut against the inner surface of the shoulder portion of the container main body 1 at the time of under-cup charging, to exhibit such a function as to preserve a passage for the propellant between the protrusion strips 26. The protrusion strips 26 may have such a cross-sectional shape as curving and protruding downward.

Figure 8:
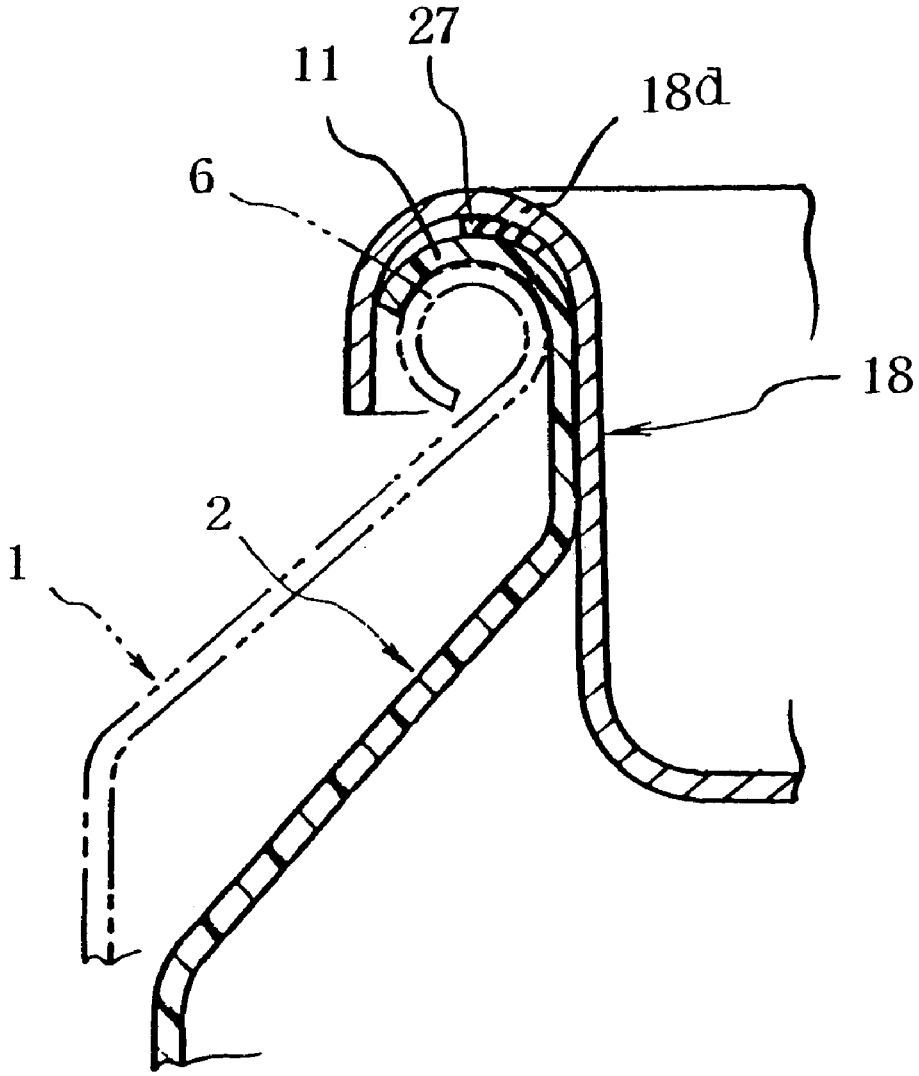
FIG. 8 is a double pressurized container for referance example.
Figure 19A:
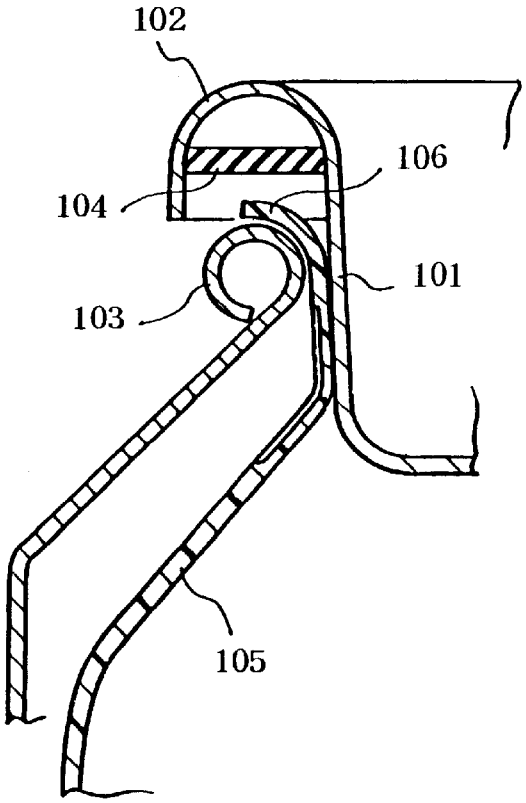
FIG. 19*a* is a cross-sectional view showing an important part of an example of a conventional double pressurized container and FIG. 19*b* is a cross-sectional view showing an important part of that container after assembled.
Figure 19B:
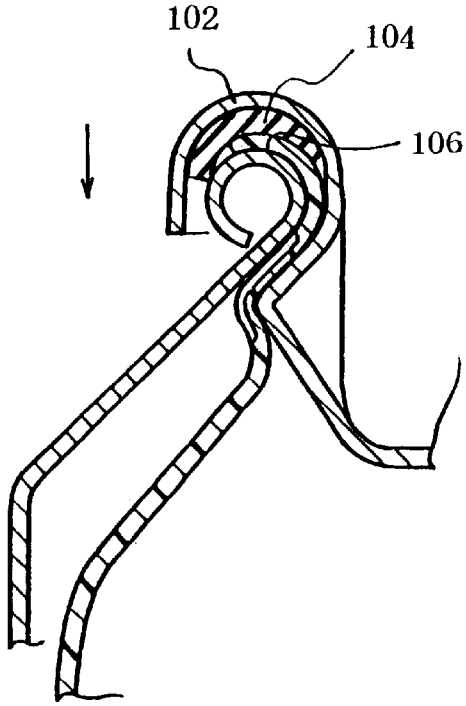
Figure 20:
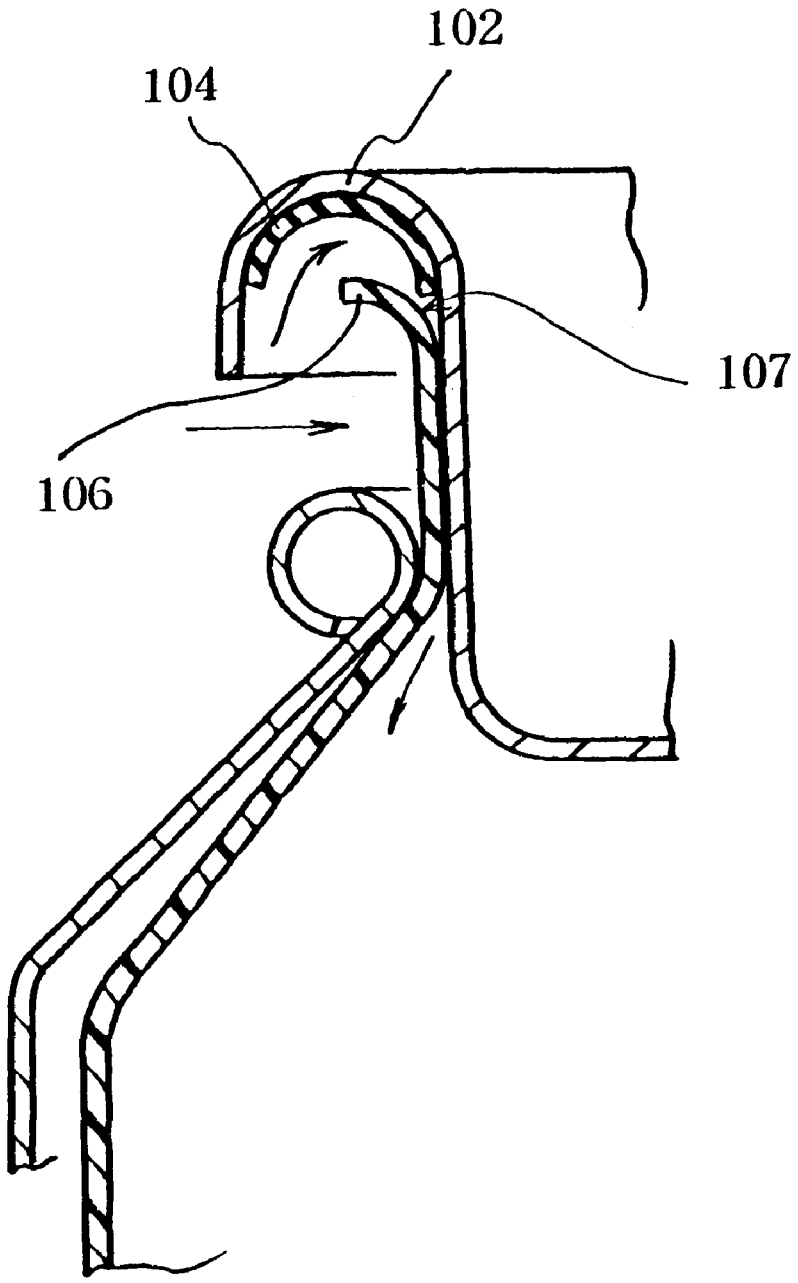
FIG. 20 is a cross-sectional view showing the important part of the double pressurized container of FIG. 19*a* at the time of under-cup charging.

All the above-mentioned embodiments use the inner bag flange portion to exhibit a sealing function between the bead portion and the curved flange and do not employ a gasket 104 such as provided to the double pressurized container shown in FIG. 19. Though not included in the present invention, the gasket, however, may be employed unless it prevents a sealing function by the inner bag flange portion between the bead portion and the curved flange. The reference example of double pressurized container shown in FIG. 8 uses a gasket 27 which has a relatively small width and also which has its outer periphery extending only close to the top of the bead portion 6. The gasket 27 is interposed between the inner bag 2 flange portion 11 and the mounting cup 18 curved flange 18*d*. The gasket 27 may be made of a conventional material. The material may an elastomeric material which includes, for example, acrylonitrile butadiene rubber (NBR), stylene butadiene rubber (SBR), butadiene rubber (BR), butyl rubber (IIR), isoprene rubber (IR), chloroprene rubber (CR), ethylene propylene rubber (EPT, EPDM), fluorine rubber, silicone rubber, and other synthetic rubber, natural rubber, soft synthetic resin, and the like.

When such a gasket 27 is employed, the sealing function by means of the inner bag 2 flange portion 11 is not deteriorated at the time of under-cup charging, thus preventing the propellant from entering the inner bag 2. Moreover, after assembly, the elasticity of the gasket 27 as well as the synergism between the flange portion 11 and the gasket 27 further improve a sealing function between the curved flange 18*d* and the inner bags 2 and a sealing function between the inner bag 2 and the bead portion 6. Moreover, if relaxation may occur at the inner bag 2 flange portion 11, the sealing force is not deteriorated, thus beneficially maintaining a sealing function for a long time.

Figure 9:
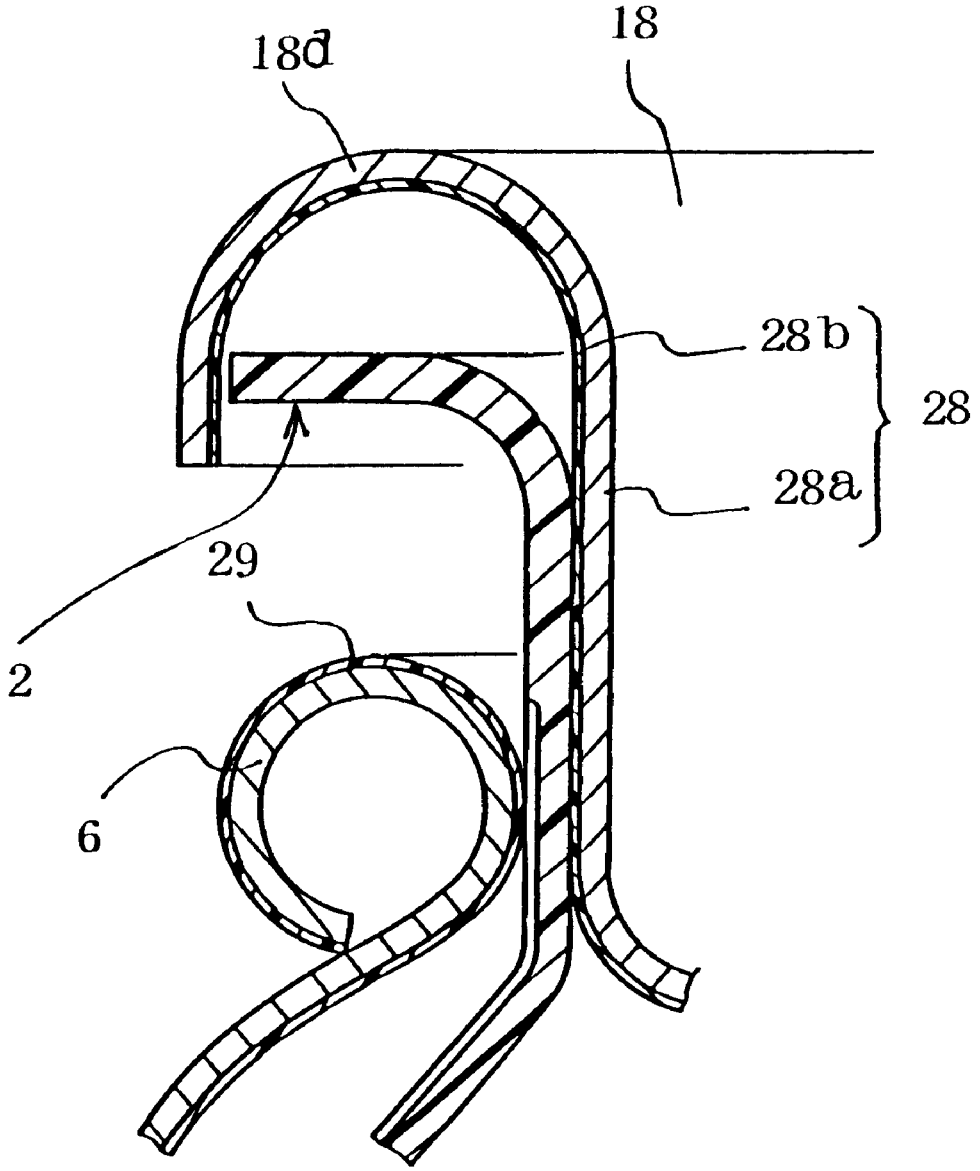
FIG. 9 is a cross-sectional view showing the important part of the double pressurized container according to a still another embodiment of the present invention.

In the pressurized container shown in FIG. 9, a mounting cup 18 is made of a laminated sheet 28 which comprises a metal sheet 28*a* and an underlying (inner side of the container) synthetic resin film 28*b* or sheet which is made of polyethylene, polypropylene, polyethylene telephtalate, ethylene-vinyl alcohol copolymer, and nylon. The film can be use not only with single layer but also with laminated layers. To assemble this, therefore, a sealing function between the inner bag 2 and the mounting cup 18 becomes large, further preventing the propellant from entering the inner bag 2. Moreover, the sealing function after the assembly of the pressurized product can be enlarged. In the pressurized container shown in FIG. 9, on the container main body 1, particularly on the inner surface of the bead portion 6 also, a synthetic resin film 29 or sheet made of the above-mentioned materials is laminated. Therefore, the sealing function becomes large between the container main body 1 bead portion 6 and the inner bag 2 flange portion 11 as well as between the bead portion 6 and the curved flange 18*d*, thus surely preventing leakage of the propellant or concentrate even without a gasket.

Figure 10A:
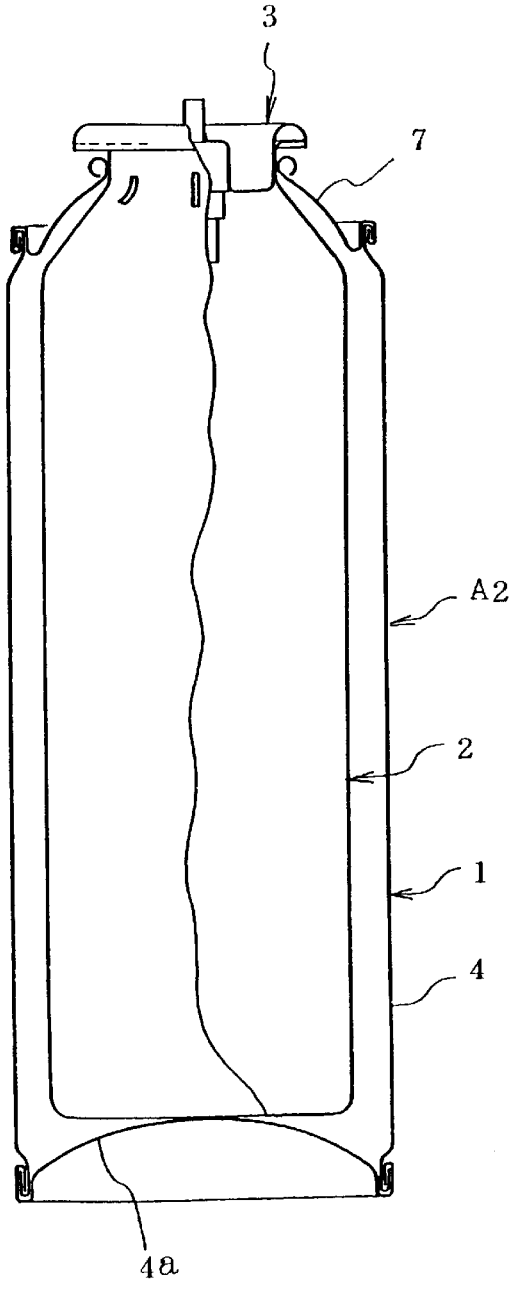
FIG. 10*a* is a vertical cross-sectional view showing the double pressurized container according to a still another embodiment and FIG. 10*b* is an expanded cross-sectional view showing the important part.
Figure 10B:
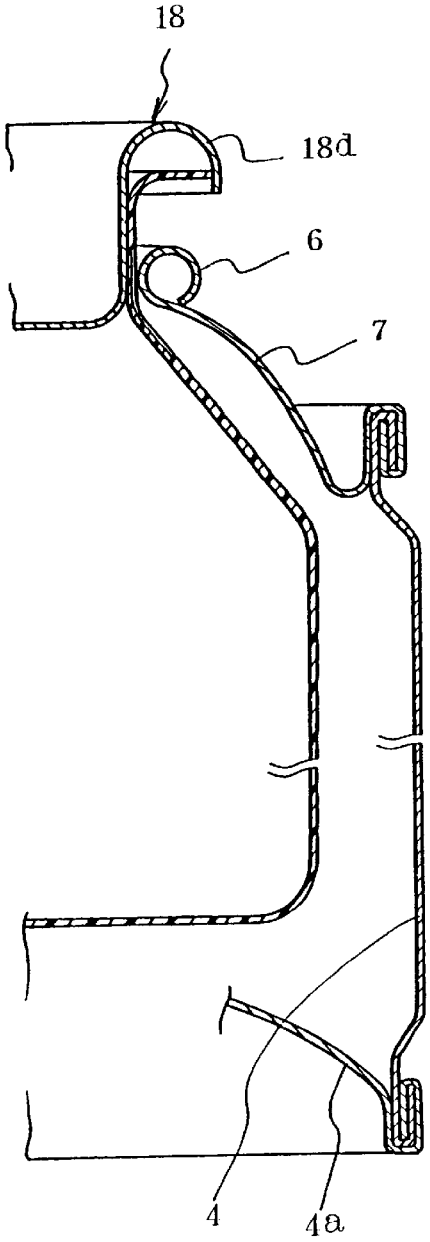

Although the above-mentioned pressurized containers all have the shoulder portion 5 integrally formed at the upper end of the barrel portion 4 of the container main body 1, as shown in FIGS. 10A and 10B, at the upper end of the barrel portion 4 made of a cylindrical metal sheet such as tinned steel sheet (tin plate) is double-wind-tightened and fixed a dome 7 formed from a tinned steel sheet so that the bead portion 6 disposed at the upper end opening of the dome 7 is covered and mounted with the curved flange 18*d* of the mounting cup 18. In this pressurized container A2, the bottom portion 4*a* is likewise double-wind-tightened and fixed to the lower end of the barrel portion 4, thus overall providing a so-called a three-piece can. Even such a double pressurized container A2 exhibits the same functions and effects as mentioned above at the time of under-cup charging.

Figure 11:
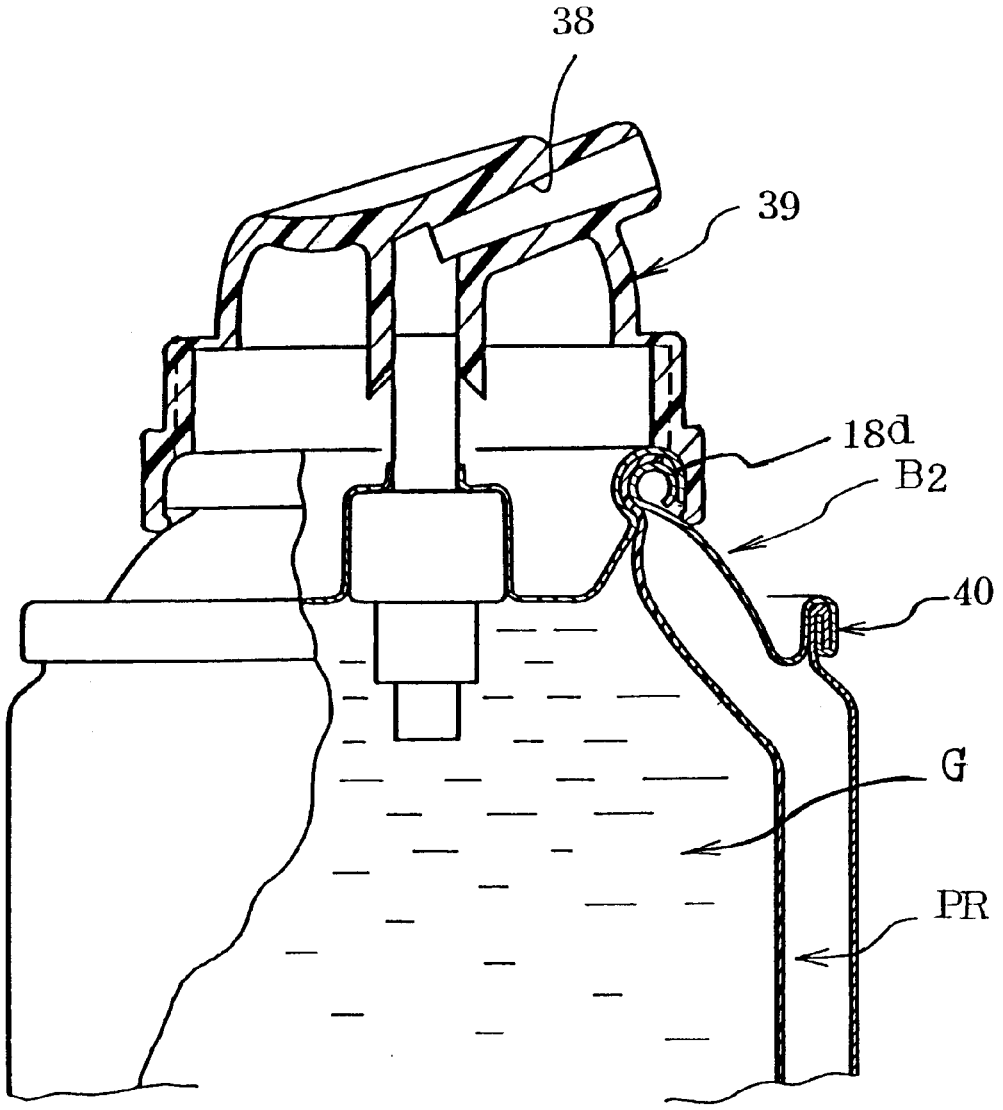
FIG. 11 is a partial cross-sectional side view showing an important part of a pressurized product employing that double pressurized container according to one embodiment of the present invention.

FIG. 11 shows a double pressurized product B2 in which the inner bag 2 of the pressurized container shown in FIG. 10 is charged with a concentrate G and a gap space between the inner bag 2 and the container main body 1 is charged with a propellant PR and then a one-touch cap 39 equipped with a spout 38 is mounted. Although, in this embodiment, the one-touch cap 39 is mounted to the curved flange 18*d* of the mounting cap 18, it may be mounted to the double-wind-tightened portions 40 of the dome 7 and the barrel portion 4.

The propellant used may include compressed gas such as nitrogen, carbon dioxide gas, dinitrogen monoxide, compressed air, argon gas, and liquefied gas such as petroleum gas (LPG), dimethyl ether (DEM), fleon gas, etc. and mixtures thereof.

Figure 13:
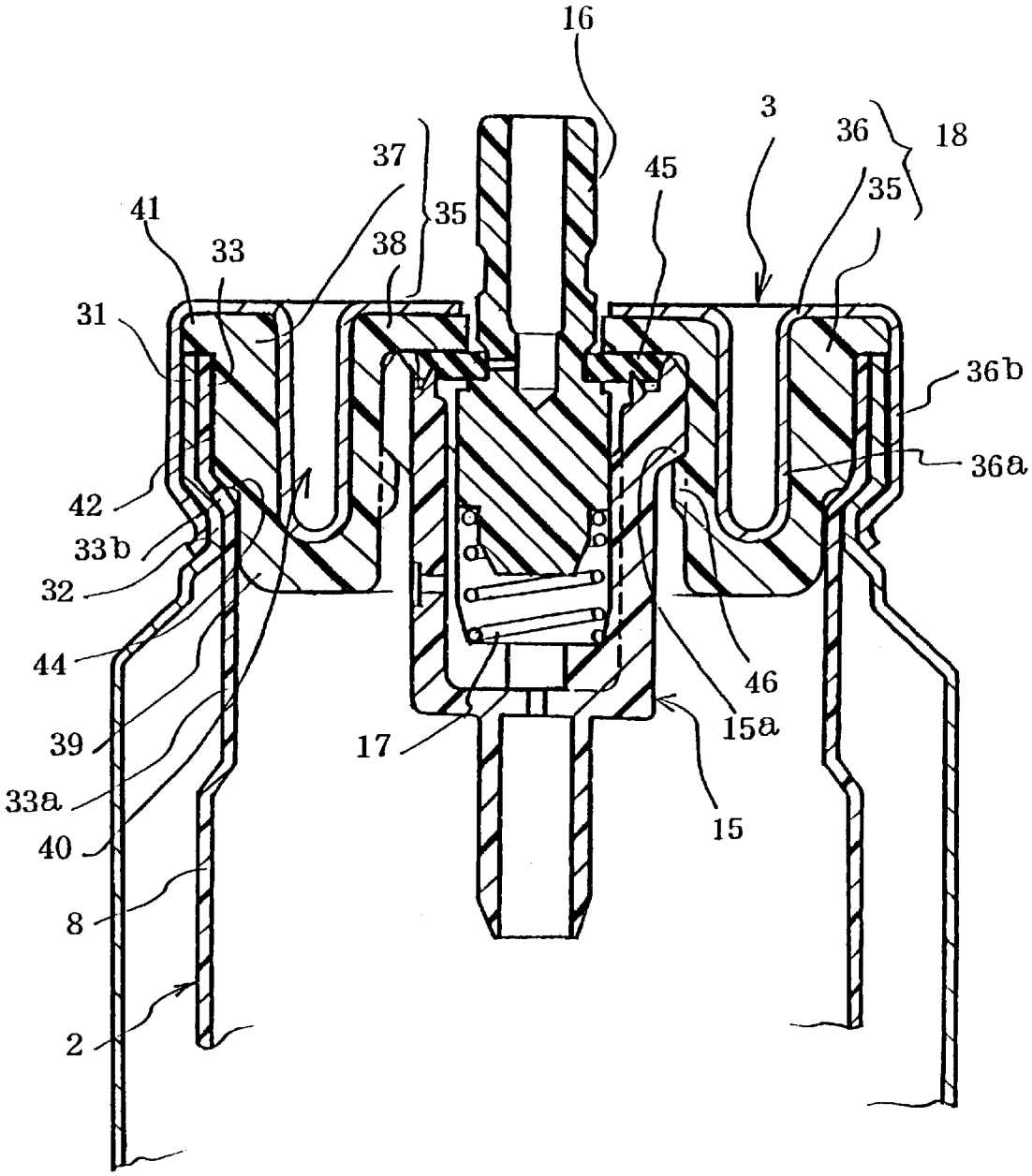

The double pressurized product B3 shown in FIG. 12 is equipped with the container main body 1 with a relatively small, preferably 15–35-mm diameter, at the upper end of which is provided with no bead portion, instead, an upper portion 31 is cylindrically extending from the shoulder portion 30. As shown in FIG. 13, at the lower part of the cylindrical portion 31 is provided an annular protrusion 32 which protrudes inward. The container main body 1 and other components are essentially the same as those of the above-mentioned container main body 1 of the pressurized container A.

Figure 14:
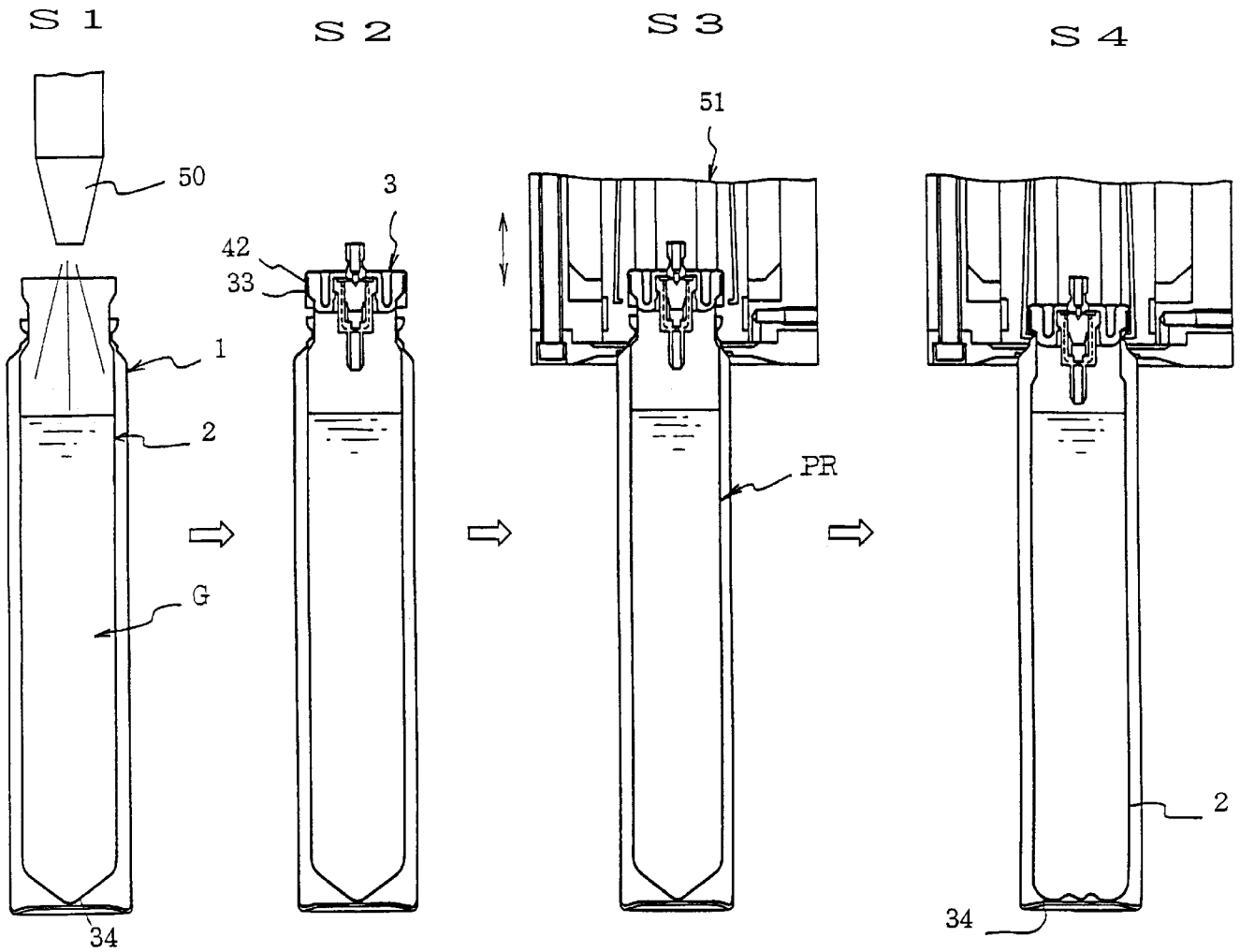
FIG. 14 is a flow diagram showing steps for assembling that double pressurized product.

The inner bag 2 is formed from synthetic resin etc. like in the above-mentioned case. The inner bag 2 is, as shown in FIG. 13, equipped continuously with a fitting portion (corresponding to the neck portion) 33 which is inscribed with a cylindrical portion 31 of the container main body 1, a portion 33*a* having a slightly smaller diameter below the fitting portion 33, and a barrel portion 8 having a slightly larger diameter below that portion 33*a*. The fitting portion 33 and the smaller-diameter portion 33*a* are coupled with an inclined surface 33*b* engaged with the upper surface of the annular protrusion 32 of the container main body. The lower end 34 of the inner bag 2 is, in a normal state, sharp-edged like a cone as shown in FIG. 14 and, in an assembled state, is supported as pushed against the inner bottom surface of the container main body 1. With this also, the inner bag 2 is charged with the concentrate G, and the space between the container main body 1 and the inner bag 2 is charged with the propellant PR. The barrel portion or the opening of the inner bag 2 may partially be formed in bellows. In this case, it can easily be pressed downward and compressed and also restored.

In this embodiment, as shown in FIG. 13, the mounting cup 18 of the valve assembly 3 comprises a plug 35 fit via the inner bag 2 to the cylindrical portion 31 of the container main body 1 and a cover 36 with which the plug is mounted to the container main body. The plug 35 is equipped with a cylindrical peripheral portion 37 at which it is mounted to the container main body 1 and a cylindrical bottomed housing retainer portion 38 which is turned upside-down for holding the housing 15. Both of these are continuous at the lower part 39, between which is formed an annular groove 40 open upward. The plug 35 is usually made of polyethylene, polypropylene, nylon, polyacetal, juracon, or other synthetic resin, but may be made of other materials.

At the upper end of the peripheral portion 37 is disposed outward a radial flange portion 41 which is engaged with the upper end of the cylindrical portion 31 of the container main body 1, the lower part of which provides a rising wall 42 which is closely fitted to the fitting portion 33 of the inner bag 2. The rising wall 42 has a diameter slightly larger than the inner diameter of the fitting portion 33 of the inner bag 2 in a normal state, thus securing a sufficient sealing nature due to the fitting between them. The rising wall 42 has also at its lower part a step 44 which is engaged through the inclined surface 33*b* of the inner bag 2 with the annular protrusion 32 of the container main body 1. No gasket is interposed between the inner bag 2 and the container main body 1 nor between the container main body and the plug 35 of the mounting cup 3. No gasket is interposed between the plug 35 and the container main body 1 either.

On the inner surface of the housing retainer portion 38 is disposed an engaging protrusion 46 for engagement with a engaging step portion 15*a* of the upper part of the housing 15. The housing 15, the stem 16 so housed therein as to be movable vertically, the spring 17 for urging the stem vertically, and the valve rubber 45 are essentially the same as those with the valve assembly 3 in FIG. 1.

The cover 36 is a cup-shaped product of a thin metal sheet and its upper bottom surface is covered over the housing retainer portion 38 and the peripheral portion 37. The upper bottom surface. is also provided with a fitting portion 36*a* which abuts against the inner surface of the annular groove portion 40. The peripheral portion 36*b* of the cover 36 is fit to the outer surface of the cylindrical portion 31 of the container main body 1 and its roughly lower end is crimped into a groove formed on the side of the outer surface of the annular protrusion 32 of the container main body.

Next, a procedure for charging this double pressurized product B3 with a content is described with reference to FIG. 14. First, at the leftmost concentrate charging step S1 in FIG. 14, the inner bag 2 is put into the container main body 1. In this state, the lower end 34 of the inner bag 2 abuts against the inner bottom surface of the container main body. In this state also, a concentrate is charged through a concentrate charging nozzle 50.

Figure 15:
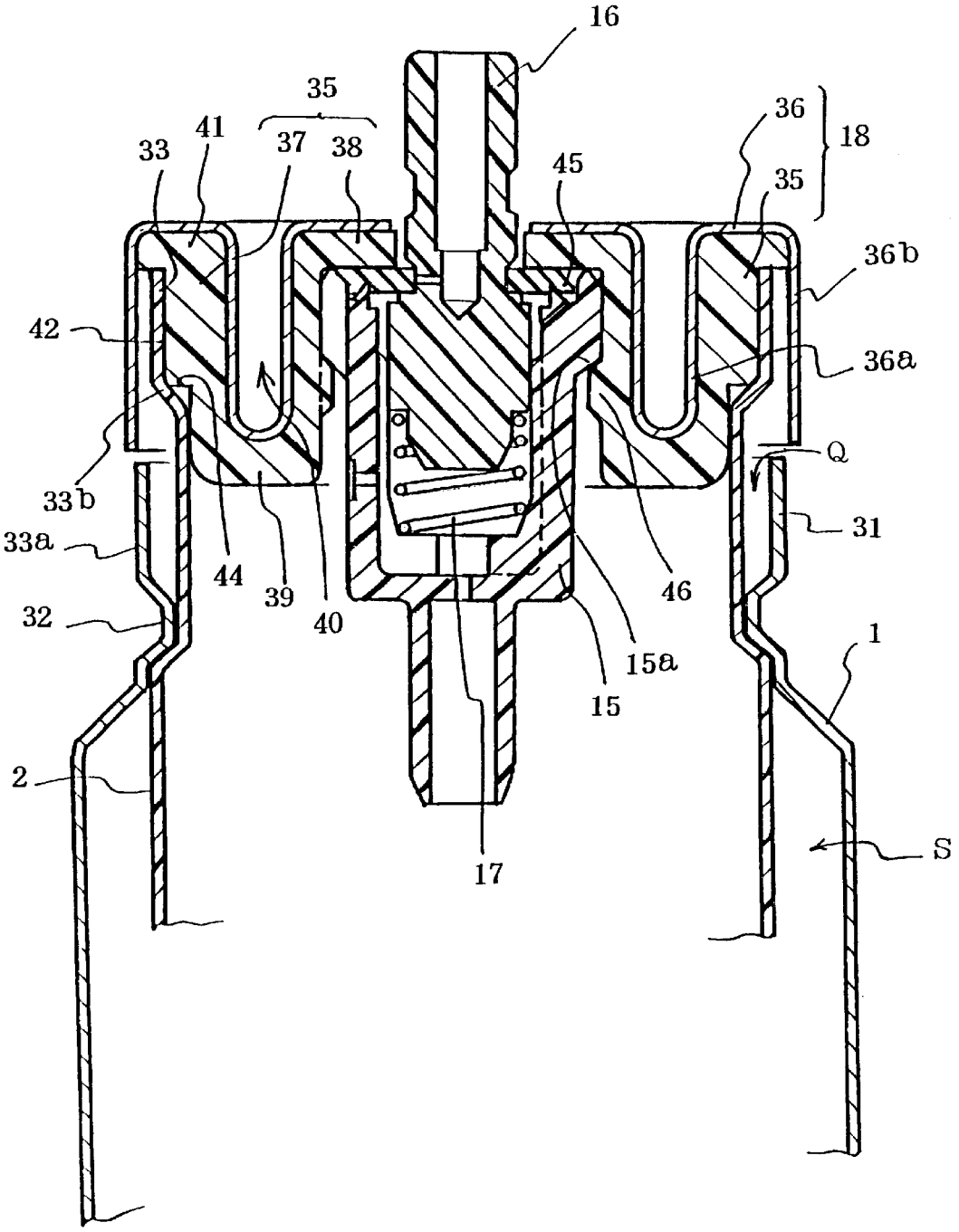
FIG. 15 is an expanded cross-sectional view showing an important part of that double pressurized product at the time of under-cup charging.

Next, the valve assembly 3 is mounted at the. upper end of the inner bag 2 (valve mounting step S2). In this state, as mentioned above, the inner surface of the fitting portion 33 of the inner bag 2 abuts closely against the rising wall 42 of the plug 35, thus exhibiting a sealing function. Then, a propellant charging head 51 is covered around the valve assembly 3 and the container main body 1, to charge through a gap between the mounting cup 18 and the container main body 1 (propellant charging step S3). In this state, as shown by an arrow Q in FIG. 15, the propellant enters a space S between the inner bag 2 and the container main body 1 through a gap between the cylindrical portion 31 of the container main body and the small-diameter portion 33*a* of the inner bag. The propellant used here may be the above-mentioned compressed gas or liquefied gas.

Although the propellant is compressed with a high pressure, the fitting portion 33 of the inner bag 2 strongly abuts against the rising wall 42 of the plug 35 and, also, comes in close contact with it because of the high pressure, the propellant does not enter the inner bag 2 through the gap therebetween.

When charging is completed, the valve assembly 3 is fit to the upper end of the container main body 1 and crimped at the surrounding (valve crimping step S4). In this state, a bottom portion 34 of the inner bag 2 is pressed against the inner bottom surface of the container main body 1 and deformed to some extent. Thus, the valve assembly 3 is mounted to the container main body 1 and the spout fitted one-touch cap 20 and the cover cap 20*a* are mounted, thereby obtaining a double pressurized product B3 shown in FIG. 12.

Figure 16:
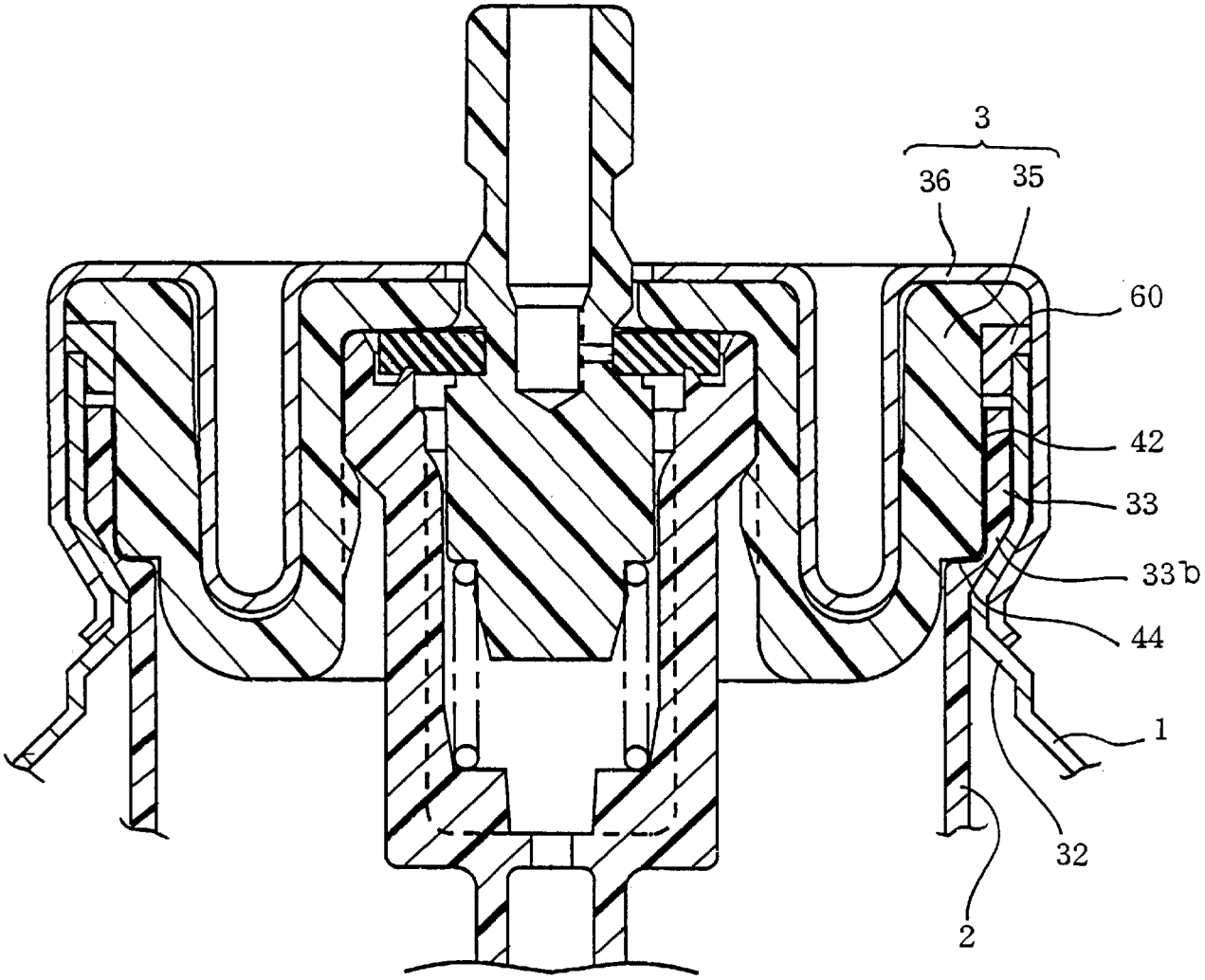
FIG. 16 is a cross-sectional view showing an important part of the double pressurized product according to a still another embodiment of the present invention.

FIG. 16 shows a state where in the pressurized product shown in FIG. 13, a ring-shaped gasket 60 is interposed between the upper end of the cylindrical portion 31 of the container main body 1 and the flange 41 of the plug 35 of the mounting cup 3. The lower part of the gasket 60 is sandwiched between the rising wall (side wall) 42 of the plug 35 and the inner surface of the container main body 1, thus exhibiting a sealing function. In this embodiment, the gasket 60 does not abut against the upper end of the cylindrical fitting portion 33 of the inner bag 2. The gasket 60 Say be made of a conventional material. The material may include acrylonitrile butadiene rubber (NBR), stylene butadiene rubber (SBR), butadiene rubber (BR), butyle rubber (IIR), isoprene rubber (IR), chroloprene rubber (CR), ethylene propyrene rubber (EPT, EPDM), fluorine rubber, silicone rubber, and other synthetic rubber, natural rubber, and soft synthetic resin and other elastomers.

In this embodiment, the gasket 60 is interposed between the plug 35 and the container main body 1, so that after assembly, the inside of the container main body 1 is securely sealed against the outside environment. With this, even if a sealing function is not sufficient between the inner bag 2 and the container main body 1, the gas leaks little. Note here that the inclined surface 33*b* of the inner bag 2 is strongly sandwiched between the corner portion of the step portion 44 of the side wall of the plug 35 and the upper surface of the annular protrusion 32 of the container main body 1. With this, the inside of the inner bag 2 can enjoy a high sealing function for a long period of time. Therefore, there is little risk of the propellant entering the inner bag 2.

Figure 17:
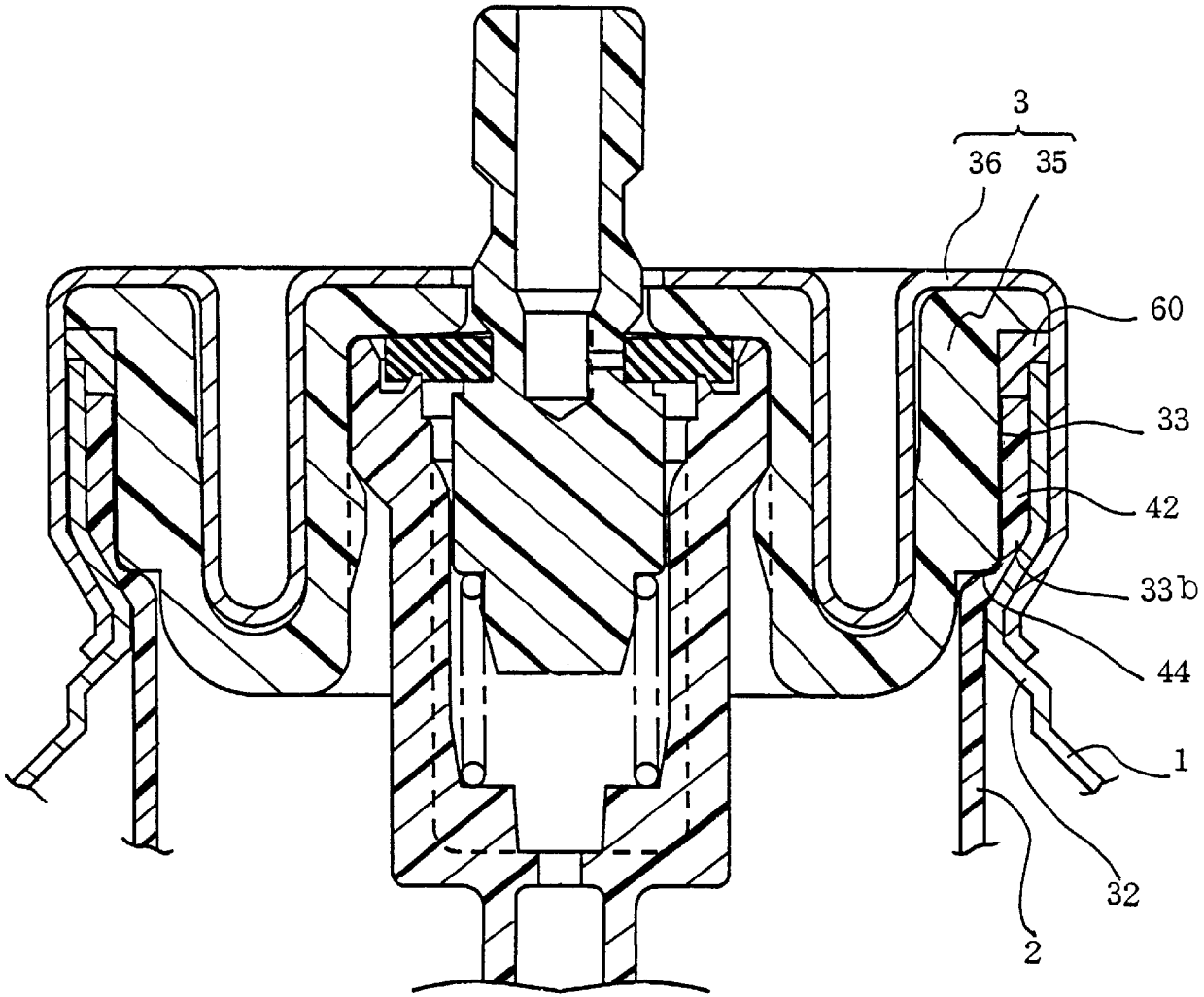
FIG. 17 is a cross-sectional view showing an important part of a double pressurized product according to an embodiment of the present invention.

In a pressurized product shown in FIG. 17, the upper end of the inner bag 2 extends upward so as to securely abut against the above-mentioned gasket 60 after assembly. Therefore, the inside of the inner bag 2 is further securely sealed for a long time. The other components are the same as those of the pressurized container shown in FIG. 16.

Figure 18:
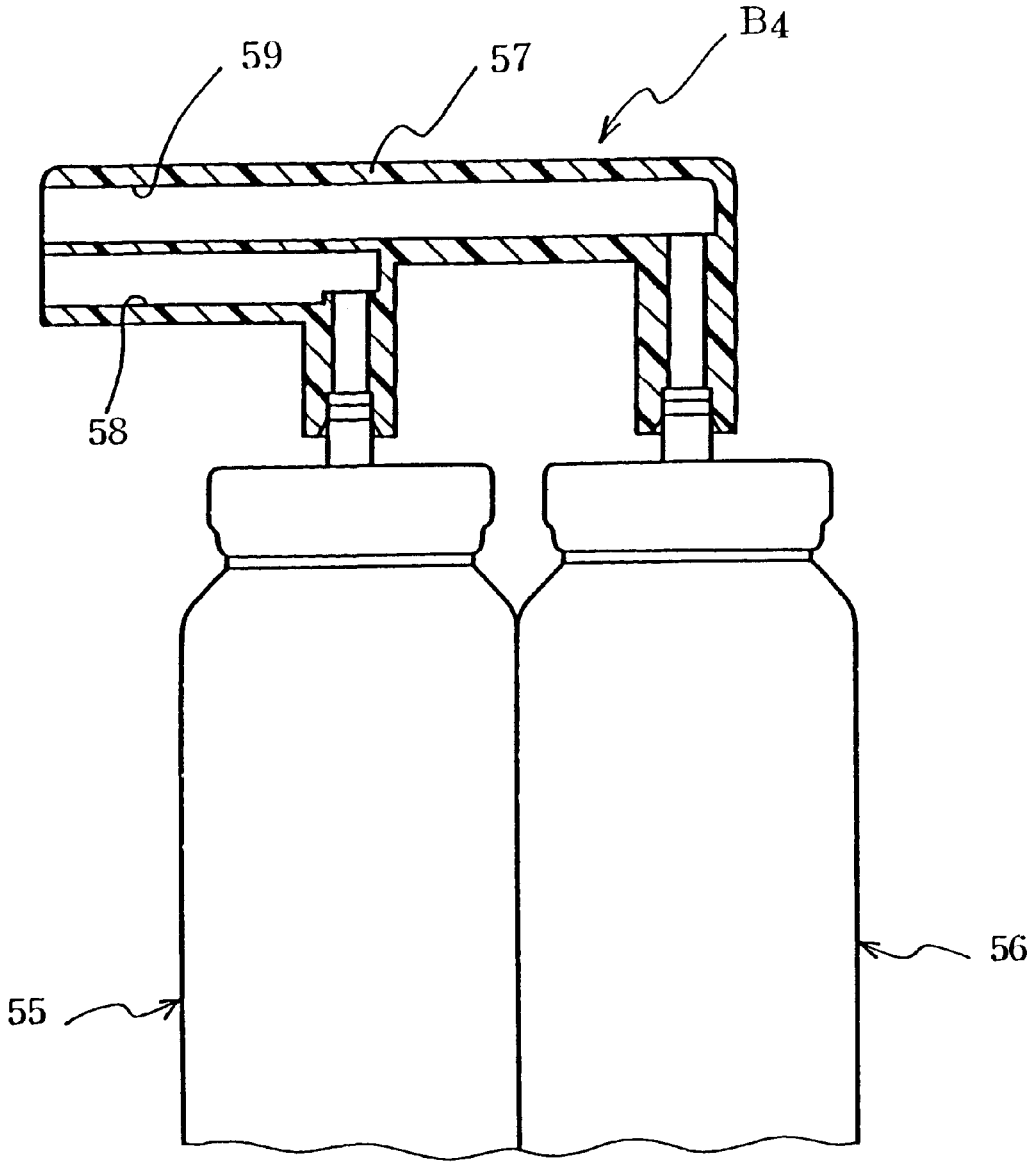
FIG. 18 is a cross-sectional view showing a part of the tandem-type double pressurized product according to an embodiment of the present invention.

FIG. 18 shows a two-liquid-mixing type pressurized product B4 using a double pressurized container according to the present invention. This product comprises a first pressurized container 55 and a second pressurized container 56 which are the same as the pressurized container of the pressurized product B3 shown in FIG. 12, and a two-liquid-mixing type push button 57 attached to the stems of these containers. The inner bag of the first pressurized container 55 is charged with a first agent containing for example oxidation dye, and the inner bag of the second pressurized container 56 is charged with a second agent containing an oxidizer. The push button 57 has a first spout 58 in communication with a first aerosol container stem and a second spout 59 in communication with a second pressurized container 56 stem. The first spout 58 and the second spout 59 extend parallel to each other and have their own openings adjacent to each other.

When this push button 57 of the pressurized product B4 is pressed, the first agent is ejected from the first pressurized container 55 and the second agent, from the second pressurized container 56 simultaneously. These, therefore, may be appropriately used as a two-concentrate type hair dye.

The concentrate charged into the inner bag of a double pressurized product according to the present invention is not in particular restricted but may include medicines, quasi-drug ingredients, cosmetics, miscellaneous agents, etc. The above-mentioned medicines may include antiphlogistic antalgesia, nasal spray, eye drop, hurt medichine etc.; and the quasi-drug ingredients may include hair dye, oral-refreshment, anti-tragomaschalia, anti-perspirant, hair restoration tonic, permanent-wave agent, bathing agent, medical cosmetics, medical tooth paste, evasive agent, insecticide, etc. The cosmetics may include hair cream, hair spray, hair foam, hair tonic, hair dye, and other hair-use cosmetics, after-shave lotion, general cosmetic lotion, eau de Cologne, sunscreen lotion, other cosmetic lotions, cleansing cream, shaving cream, latex, cold cream, hand cream, other creams, baby oil, and other cosmetic oils, packing cosmetics, etc. The miscellaneous agents may include industrial products, automobile products, deodorants, glass cleaners, and other domestic products.

Preferably, the above-mentioned product pressure is 0.3–1.0 MPa at 20° C. when a compressed gas is used as the propellant and at most 0.8 MPa at 35° C. when a liquefied gas is used as the propellant.

The agent type of the above-mentioned products is not limited to the above-mentioned, and a liquid, cream, pate, gel, or foam state can be employed, but may preferably be a cream, pate, or gel state because these highly viscous contents are meritorious for effectuating the properties of the double pressurized container. Also, such material solutions, e.g. hair dye, as those which are liable to corrode metal in contact with themselves.

The above-mentioned hair dye disclosed in Japanese Patent Application Laid-Open Nos. Hei-8-231345, Hei-8-230959, Hei-7-258045, Hei-8-301740, and Hei-26943 contains aqueous hydrogen peroxide has poor container stability and hates contact with metal, thus being preferably used in a double pressurized container according to the present invention. That is, aqueous hydrogen peroxide itself is very liable to decompose and react with metal to give oxygen, thus sometimes producing an abnormal rise in the inner pressure. To guard against this, as described in the present invention, it should preferably be charged in an inner bag, to which is then applied a pressure of the propellant from the surrounding.

Particularly as for a two-liquid-reactive hair dye, the above-mentioned tandem-type double pressurized container shown in FIG. 18 may appropriately be used.

As the first agent, for example, a blend of an oxidizing dye, alkali agent, surfactant, etc. is used, and as the second agent, an agent containing an oxidizer for oxidizing that oxidizing dye is used. That oxidizing dye consists of dye intermediate products (dye precursors) and couplers providing a variety of color tones given by combinations with the dye intermediate products. The dye intermediate is made of para components including, e.g., p-phenylene diamine and p-amino phenol, ortho components including o-phenylene diamine and o-amino phenol, comprising their derivatives. The coupler is made of meta-site phenylene diamine, amino phenol, polyhydric phenol, and the like.

The alkali agent is blended to enhance dying effects and give a light color tone by permitting concurrent proceeding of oxidized decomposition of melanin grains in the hair. Also, it acts to keep the oxidizing dye in an alkali state so as to suppress coloring in storage. The alkali agent may include ammonium water, ammonium hydrogen carbonate, and mono-ethanol amine. Besides the above-mentioned ones, the first agent may be a blend of resorcinol, used as the oxidizing dye, oreic acid and other fat-and-oil phase bases, polyoxyethylene (10) orein alcohol ether and other surfactant, isopropyl alcohol and other solubilizing agents, carboxyvinyl polymer and other thickeners, and purified water for increasing quantity, antioxidants, and the like. The pH index of the first agent is typically 8–13 and preferably 9–11 particularly.

The second agent, on the other hand, uses for example aqueous 30% hydrogen peroxide as the oxidant, and a purified water, a stabilizer etc. are mixed therewith. The pH index of the second agent is typically 2–5, preferably 2–4. Also, preferably, the first and second agents should contain a thickener to adjust their viscosity. They may also be foamed. Even with this, the ejected liquid would never drop immediately.

Example

[Two-liquid hair dye] gel state

The container shown in FIG. 13 was prepared two, and each inner bag of these two containers are charged with the first and second agents of the two-liquid hair dye and then charged with a nitrogen gas through a gap between the inner bag and the opening in the container according to a method shown in FIG. 14 and then had the valve crimped. The product pressure was 0.7 Mpa at 20° C., and by ejecting them, the same amount of contents in a gel state can be ejected.

What is claimed is:

1. A double pressurized container for under-cup charging comprising a container main body having an opening at an upper end, a mounting cup so mounted as to close said opening, and a flexible inner bag interposed between said container main body and said mounting cup;

wherein said mounting cup is equipped with a plug inserted into an inner surface of said container main body with an inner bag therebetween and a cup-shaped cover made of a metal sheet which covers said plug and also a periphery of which is crimped to an outer periphery of said container main body;

wherein said plug slightly expands the inner bag when said plug is fitted therein; and wherein said container main body is equipped with a cylindrical portion at an upper part and an annular protrusion which protrudes toward an inner side of said cylindrical portion, said inner bag has a cylindrical portion which is engaged to said cylindrical portion of said container main body, and said inner bag is sealed, being clamped between a side step portion and said annular protrusion of said mounting cup.

2. The double pressurized container according to claim 1, wherein said plug is equipped with a flange portion which covers said container main body and an upper end of said inner bag.

3. The double pressurized container according to claim 1, wherein a gasket is interposed between said plug said upper part of said container main body in order to seal tightly.

4. The double pressurized container according to claim 1, wherein a gasket is interposed between said plug and said inner bag in order to seal tightly.

5. The double pressurized container according to claim 1, wherein said inner bag has a height such that a bottom of said inner bag may be supported by an inner bottom surface of said container at time of under-cup charging.

6. A double pressurized product comprising the double pressurized container according to claim 1, a concentrate charged in said inner bag, and a propellant charged in a gap between said inner bag and said container main body.

7. A double pressurized product according to claim 6 wherein two pieces of the double pressurized product are coupled.

* * * * *